US011161130B2

(12) United States Patent
Bartolucci et al.

(10) Patent No.: US 11,161,130 B2
(45) Date of Patent: Nov. 2, 2021

(54) MULTI-COMPOSITION PRODUCT DISPENSER

(71) Applicant: The Procter & Gamble Company, Cincinnati, OH (US)

(72) Inventors: Stefano Bartolucci, Singapore (SG); Todd Mitchell Day, Bethel, OH (US); Christopher Luke Leonard, Mason, OH (US); Paul Owen Nutley, West Chester, OH (US); Michael Vincent Schlasinger, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/924,269

(22) Filed: Jul. 9, 2020

(65) Prior Publication Data

US 2021/0008578 A1 Jan. 14, 2021

Related U.S. Application Data

(60) Provisional application No. 62/871,715, filed on Jul. 9, 2019.

(51) Int. Cl.
*B05B 11/00* (2006.01)
*B05B 1/14* (2006.01)

(52) U.S. Cl.
CPC ..... *B05B 11/0078* (2013.01); *B05B 1/14* (2013.01); *B05B 11/3001* (2013.01)

(58) Field of Classification Search
CPC ... B05B 1/14; B05B 11/3001; B05B 11/0078; B05B 11/0075; B65D 81/3288; B65D 81/3255; B65D 81/3244; B65D 81/3227; B65D 81/3283; B65D 81/3084; B65D 81/3081; B65D 83/682
USPC ..... 222/135–137, 145.1, 145.3, 183
See application file for complete search history.

(56) References Cited

U.S. PATENT DOCUMENTS 3,045,925 A 7/1962 Giangualano
3,236,457 A * 2/1966 Ladd ..... B05B 1/26 239/304
3,993,224 A * 11/1976 Harrison ..... B65D 83/303 222/135
4,773,562 A 9/1988 Gueret
4,792,062 A * 12/1988 Goncalves ..... B65D 83/68 222/135
4,826,048 A 5/1989 Skorka et al.
4,902,281 A 2/1990 Avoy
4,993,595 A 2/1991 Bertram et al.
5,020,694 A 6/1991 Pettengill
(Continued)

FOREIGN PATENT DOCUMENTS

CA 2215179 C 2/2007
CA 2215051 C 11/2008
(Continued)

OTHER PUBLICATIONS

IPLUS Search Results (and attached) generated by USPTO support staff based upon a request on Mar. 15, 2021 (Year: 2021).*
(Continued)

*Primary Examiner* — Donnell A Long
(74) *Attorney, Agent, or Firm* — John G. Powell

(57) ABSTRACT

A multi-composition product dispenser capable of concurrently dispensing at least a first and second composition is provided.

19 Claims, 14 Drawing Sheets

(56) References Cited

U.S. PATENT DOCUMENTS

| | | | | |
|---|---|---|---|---|
| 5,137,178 | A | 8/1992 | Stokes et al. | |
| 5,252,312 | A | 10/1993 | Gentile et al. | |
| 5,289,949 | A | 3/1994 | Gentile | |
| 5,332,124 | A | 7/1994 | Cancro et al. | |
| 5,398,846 | A | 3/1995 | Corba et al. | |
| 5,611,463 | A | 3/1997 | Favre | |
| 5,645,193 | A | 7/1997 | Gentile et al. | |
| 5,740,947 | A | 4/1998 | Flaig et al. | |
| 5,794,819 | A | 8/1998 | Smith | |
| 5,862,949 | A | 1/1999 | Markey et al. | |
| 5,899,360 | A | 5/1999 | Mack et al. | |
| 5,954,213 | A | 9/1999 | Gerhart et al. | |
| 6,039,215 | A | 3/2000 | Bell | |
| 6,063,223 | A | 5/2000 | Klauke et al. | |
| 6,082,588 | A | 7/2000 | Markey et al. | |
| 6,135,323 | A | 10/2000 | Chen et al. | |
| 6,161,729 | A | 12/2000 | Gentile et al. | |
| 6,186,992 | B1 | 2/2001 | Roe et al. | |
| 6,230,935 | B1 | 5/2001 | Mack et al. | |
| 6,308,862 | B1 | 10/2001 | Fillmore et al. | |
| 6,308,863 | B1 | 10/2001 | Harman | |
| 6,454,135 | B1 | 9/2002 | Brozell | |
| 6,499,900 | B1 | 12/2002 | Brozell | |
| 6,583,103 | B1 | 6/2003 | Klinkhammer | |
| 6,722,532 | B2 | 4/2004 | Lasserre et al. | |
| 6,758,411 | B2 | 7/2004 | Conway et al. | |
| 7,195,135 | B1 * | 3/2007 | Garcia | B05B 11/3084 222/137 |
| 7,222,752 | B2 | 5/2007 | Ponton | |
| 7,290,681 | B2 * | 11/2007 | Decottignies | B05B 11/0078 222/135 |
| 7,651,035 | B2 * | 1/2010 | van der Heijden | B01F 15/0226 239/1 |
| 7,654,415 | B2 | 2/2010 | Van | |
| 7,665,631 | B2 | 2/2010 | Pikowski | |
| 7,845,518 | B2 | 12/2010 | Lasserre et al. | |
| 8,021,064 | B2 | 9/2011 | Gueret | |
| 8,413,849 | B2 | 4/2013 | Flores | |
| 9,303,820 | B2 | 4/2016 | Miller | |
| 9,579,676 | B1 * | 2/2017 | Burrowes | A61L 9/14 |
| 9,586,714 | B2 | 3/2017 | Kountotsis | |
| 9,655,431 | B2 * | 5/2017 | Ham | A45D 40/00 |
| 9,693,619 | B2 | 7/2017 | Ki | |
| 9,776,787 | B2 | 10/2017 | Nakajima | |
| 9,839,931 | B2 * | 12/2017 | Burrowes | B05B 11/3084 |
| 10,029,267 | B2 | 7/2018 | Connolly et al. | |
| 10,335,818 | B2 * | 7/2019 | Pointel | B05B 11/3084 |
| 2002/0074347 | A1 | 6/2002 | Murray et al. | |
| 2003/0089738 | A1 | 5/2003 | Peterson | |
| 2003/0121936 | A1 | 7/2003 | De | |
| 2005/0205600 | A1 | 9/2005 | Ophardt et al. | |
| 2006/0021996 | A1 | 2/2006 | Scott et al. | |
| 2006/0049278 | A1 | 3/2006 | Hoshino | |
| 2006/0065674 | A1 | 3/2006 | Lasserre et al. | |
| 2007/0029344 | A1 | 2/2007 | Schymitzek et al. | |
| 2007/0158461 | A1 | 7/2007 | Rymer et al. | |
| 2010/0025427 | A1 | 2/2010 | Chiou et al. | |
| 2012/0000935 | A1 * | 1/2012 | Brunk | B65D 83/682 222/137 |
| 2015/0305474 | A1 * | 10/2015 | Ham | A45D 34/00 222/135 |
| 2016/0128915 | A1 | 5/2016 | Konno et al. | |
| 2016/0318055 | A1 | 11/2016 | Scott et al. | |
| 2017/0028422 | A1 | 2/2017 | Martines | |
| 2017/0029197 | A1 | 2/2017 | Martines | |
| 2017/0367461 | A1 | 12/2017 | Tsubouchi et al. | |
| 2018/0022526 | A1 | 1/2018 | Demarest et al. | |
| 2018/0044099 | A1 | 2/2018 | Nakajima et al. | |
| 2018/0319573 | A1 | 11/2018 | Yamaguchi et al. | |
| 2019/0038523 | A1 | 2/2019 | Konno et al. | |
| 2019/0039806 | A1 | 2/2019 | De Cleir | |
| 2020/0307891 | A1 | 10/2020 | Lee | |
| 2020/0346839 | A1 | 11/2020 | Lee | |
| 2021/0008578 | A1 * | 1/2021 | Bartolucci | B05B 11/3001 |
| 2021/0009336 | A1 | 1/2021 | Bartolucci et al. | |

FOREIGN PATENT DOCUMENTS

| | | |
|---|---|---|
| CN | 108792251 A | 11/2018 |
| EP | 0873945 B1 | 8/2003 |
| FR | 1413164 | 10/1965 |
| FR | 2647093 | 11/1990 |
| JP | 04944493 | 5/2012 |
| KR | 101817077 | 1/2018 |
| WO | 2005102539 | 11/2005 |
| WO | 2008012191 | 1/2008 |
| WO | 2008014833 | 2/2008 |

OTHER PUBLICATIONS

AA01360 PCT Search Report and Written Opinion for PCT/US2020/070245 dated Sep. 22, 2020.

All Office Actions, U.S. Patent Application U.S. Appl. No. 16/924,264.

* cited by examiner

MULTI-COMPOSITION PRODUCT DISPENSER

FIELD OF THE INVENTION

The present invention relates generally to a product dispenser suitable for dispensing two or more compositions.

BACKGROUND OF THE INVENTION

Dual compositions product dispensers are generally known including those for personal care compositions. One advantage of such products is separating compositions that are otherwise incompatible, or at least incompatibly contained together. One way to dispense these dual compositions is by side-by-side dual outlets nozzle. Another way to dispense product is by concentric, or at least partially concentric, dual outlets nozzle; however, the mechanical complexity increases with such a configuration. On the other hand, one advantage of having such concentric outlets is the aesthetics of the dispensed product that can be achieved. This is particularly important for more discerning users, especially given the myriad of choices available in the market place. However, many of these product dispensers are not optimized for relatively viscous compositions and/or compact in design. Moreover, there is also continuing need for dispensers that have relatively broad manufacturing tolerances and/or are relatively economical to manufacture (on high lines).

SUMMARY OF THE INVENTION

The present invention addresses one or more of these needs. One aspect of the invention provides a product dispenser capable of concurrently dispensing at least a first composition and a second composition. The dispenser comprising: a first container (for containing the first composition) and a second container (for containing the second composition). The dispenser further comprises a multi-composition flow director, wherein the flow director comprises: a first flow director cavity in fluid communication with the first container, wherein the first flow director cavity comprises a first cavity inlet planar opening, wherein the first cavity inlet planar opening comprises a first cavity inlet planar opening centroid, wherein a first cavity inlet axis orthogonally intersects said first cavity inlet planar opening centroid. The flow director further comprises a second flow director cavity in fluid communication with the second container, wherein the second flow director cavity comprises a second cavity inlet planar opening, wherein the second cavity inlet planar opening comprises a second cavity inlet planar opening centroid, wherein a second cavity inlet axis orthogonally intersects said second cavity inlet planar opening centroid. The dispenser further comprises a nozzle, wherein the nozzle comprises: an inner nozzle conduit in fluid communication with the second flow director cavity; an outer nozzle conduit, at least partially extending around the inner conduit, in fluid communication with the first flow director cavity; and a nozzle longitudinal axis. Lastly, the dispenser comprises an inlet intersecting plane intersects the first cavity inlet axis and the second cavity inlet axis, and the nozzle longitudinal axis intersects said plane to form an angle from 60 degrees to 90 degrees.

Another aspect of the invention provides for a product dispenser capable of concurrently dispensing at least a first composition and a second composition. The product dispenser further comprises a first container for containing the first composition and a second container for containing the second composition. The product dispenser further comprises a multi-composition flow director comprising: a first flow director cavity in fluid communication with the first container; a second flow director cavity in fluid communication with the second container; an inner flow director sealing ring positioned between the first flow director cavity and second flow director cavity; and an outer flow director sealing ring opposing said inner flow director sealing ring along an inner/outer flow director sealing ring longitudinal axis. The product dispenser further comprises a nozzle comprising: an inner nozzle conduit in fluid communication with the second flow director cavity and fluidly sealed against the inner flow director sealing ring; an outer nozzle conduit, at least partially extending around the inner conduit, in fluid communication with the first flow director cavity and fluidly sealed against the outer flow director sealing ring; and wherein the length of the inner conduit is longer than the length of the outer conduit.

One or more advantages are described. An advantage of the product dispenser described herein is consistent and/or full dispensing of product, especially over time, and preferably without or at least minimizing backflow, especially relative to the outer nozzle outlet (in a partially concentric or fully concentric dual nozzle outlet configuration). Without wishing to be bound by theory, the minimizing nozzle length helps to facilitates a compact product dispenser design (which is especially useful for personal care compositions (e.g., skin care)). This advantage is also applicable in dispensing relatively viscous compositions, particularly lower dose volume applications.

An advantage of the product dispenser described herein is a dispenser that minimizes the amount of force required by user to exert to concurrently dispense the compositions, especially compositions that may be relatively viscous. This particularly helpful for an aging user population and/or prevent, or at least mitigate, against incomplete product dispensing.

An advantage of the product dispenser described herein is a dispenser that allows for product designers to vary the viscosity and/or nozzle outlet and/or flow channel configures to provide for a product dispenser capable of dispensing a discrete product of essentially of infinite design.

An advantage of the product dispenser described herein is a dispenser that minimizes the number of parts required for manufacturing and/or relatively high tolerances.

An advantage of the product dispenser described herein is a dispenser that avoids, or at least minimizes clogging of the nozzle, especially toward the end of product life.

An advantage of the product dispenser described herein is a dispenser that provides a relatively consistent user experience throughout the product life span, especially toward the end of the product life.

An advantage of the product dispenser described herein is a dispenser the dispensing multiple compositions in the intended ratio as to avoid having one composition empty before the second composition to avoid frustrating the user or have the user feel that the full value of the product was not realized.

An advantage of the product dispenser described herein is a dispenser for a plurality of compositions where the footprint of the flow director of each composition can be substantially the same. For example, this assures a consistent ratio of the first and second compositions immediately after priming of the two pumps.

An advantage of the product dispenser described herein is a dispenser that facilitates the mixing of the dispensed compositions external to the nozzle. This not only helps facilitate aesthetic freedom (for product designers) but helps to mitigate against contamination of otherwise incompatible compositions.

An advantage of the product dispenser described herein is a dispenser that generally avoids thin steel conditions and specifically the use of long, thin, cantilever (i.e. supported only on one side) mold inserts that are typically used in the manufacturing process of nozzle conduits, wherein these are contained within one another. This helps improve manufacturing tolerances of the nozzle conduits and ultimately enables to reliably and robustly manufacture nozzle conduits wall sections and flow paths smaller than other competing approaches. This is desired to minimize contamination in the nozzle area and achieve the desired dispensing aesthetics.

An advantage of the product dispenser described herein is a dispenser that encourages the user to provide an even actuate, especially in those examples of the product dispenser having more than on pump. This way, these multiple pumps are actuated simultaneously (pumping the intended volume and timing of the contained compositions (to which the respective pumps are in fluid communication).

These and other features of the present invention will become apparent to one skilled in the art upon review of the following detailed description when taken in conjunction with the appended claims.

BRIEF DESCRIPTION OF THE DRAWINGS

While the specification concludes with claims particularly defining and distinctly claiming the invention, it is believed that the invention will be better understood from the following description of the accompanying figures. In the accompanying figures:

DETAILED DESCRIPTION OF THE INVENTION

Definitions

All percentages, parts and ratios are based upon the total weight of the compositions of the present invention, unless otherwise specified. All such weights as they pertain to listed ingredients are based on the active level and, therefore do not include solvents or by-products that may be included in commercially available materials, unless otherwise specified. The term "weight percent" may be denoted as "wt %" herein. All molecular weights as used herein are weight average molecular weights expressed as grams/mole, unless otherwise specified.

As used herein, the articles including "a" and "an" when used in a claim, are understood to mean one or more of what is claimed or described.

As used herein, the terms "comprise", "comprises", "comprising", "include", "includes", "including", "contain", "contains", and "containing" are meant to be non-limiting, i.e., other steps and other sections which do not affect the end of result can be added. The above terms encompass the terms "consisting of" and "consisting essentially of".

As used herein, the words "preferred", "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

Figure 1:
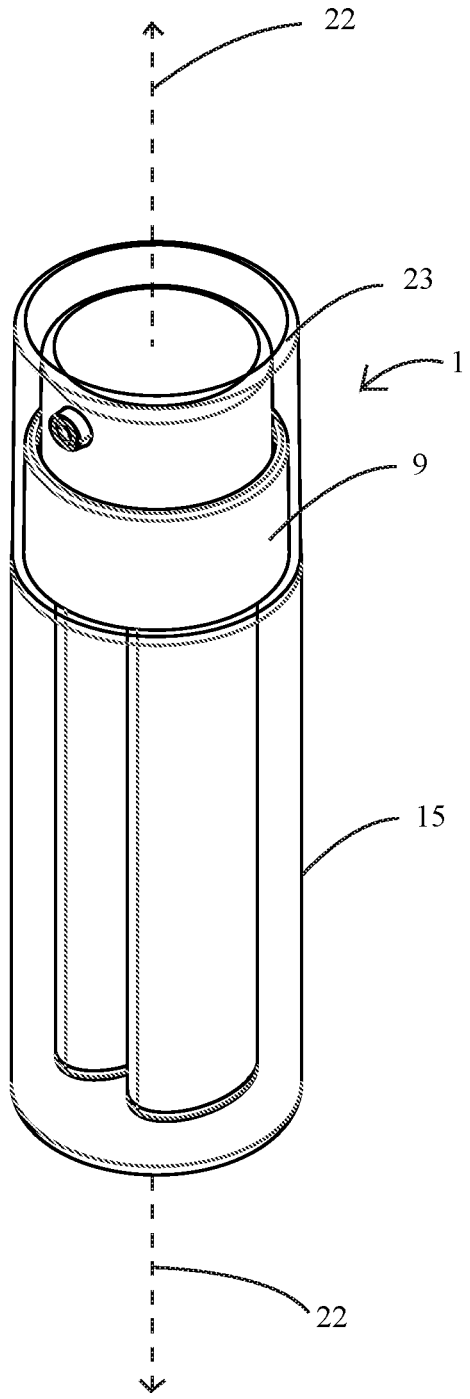
FIG. 1 is perspective view of the product dispenser.

FIG. 1 is a perspective view of the product dispenser (1). A product longitudinal axis (22) runs along the length of the product dispenser (1) orthogonally intersecting a centroid (not shown) at a plane (not shown) along the bottom of the subject product dispenser (1) (e.g., the flat surface which the product stands when in the intended upright position). Preferably at least portion of the product dispenser (1) has rotational symmetry around the longitudinal product axis (22). For example, the product dispenser (1) may generally have an overall cylindrical shape. The product dispenser (1) preferably comprises an optional removeable cap (23) (preferably at the top), which is preferably releasably affixed to a pump collar (9). The removeable cap (23) can be transparent, opaque, partially transparent, partially opaque, or combinations thereof. Preferably the cap (23) is opaque. Below the pump collar (9), and opposing the removeable cap (23), is a housing (15). The removeable cap can be affixed by snap fit or screw fit or otherwise. In turn, the housing (15) may be transparent, opaque, partially transparent, partially opaque, or combinations thereof. Preferably the housing (15) is transparent or partially transparent as to display to users the amount of dispensable composition remaining or contrasting colors between the multiple dispensable compositions contained (not shown) within the product dispenser (1).

Still referring to FIG. 1, the pump collar (9) is positioned, in one example, from 60% to 90% (alternatively 65% to 85%, or 70% to 80%, or combinations thereof) of the overall height of the product dispenser as measured along the product longitudinal axis (22). In one example, the overall height of the product dispenser (inclusive of the optional removeable cap (23)) is preferably from 125 mm to 180 mm, alternatively from 135 mm to 160 mm, or about 145 mm, or combinations thereof. The maximum width of the product dispenser, measured in plane orthogonal to the product longitudinal axis (22) is preferably from 30 cm to 60 cm, alternatively from 35 cm to 50 cm, or from 39 to 43 mm, or combinations thereof. The dimensions will depend upon the intended use of the product dispenser (1), the intended use ergonomics, and/or the size of the container volumes (discussed in further detail below). One example is a personal care product dispenser, preferably skincare product dispenser.

Figure 2:
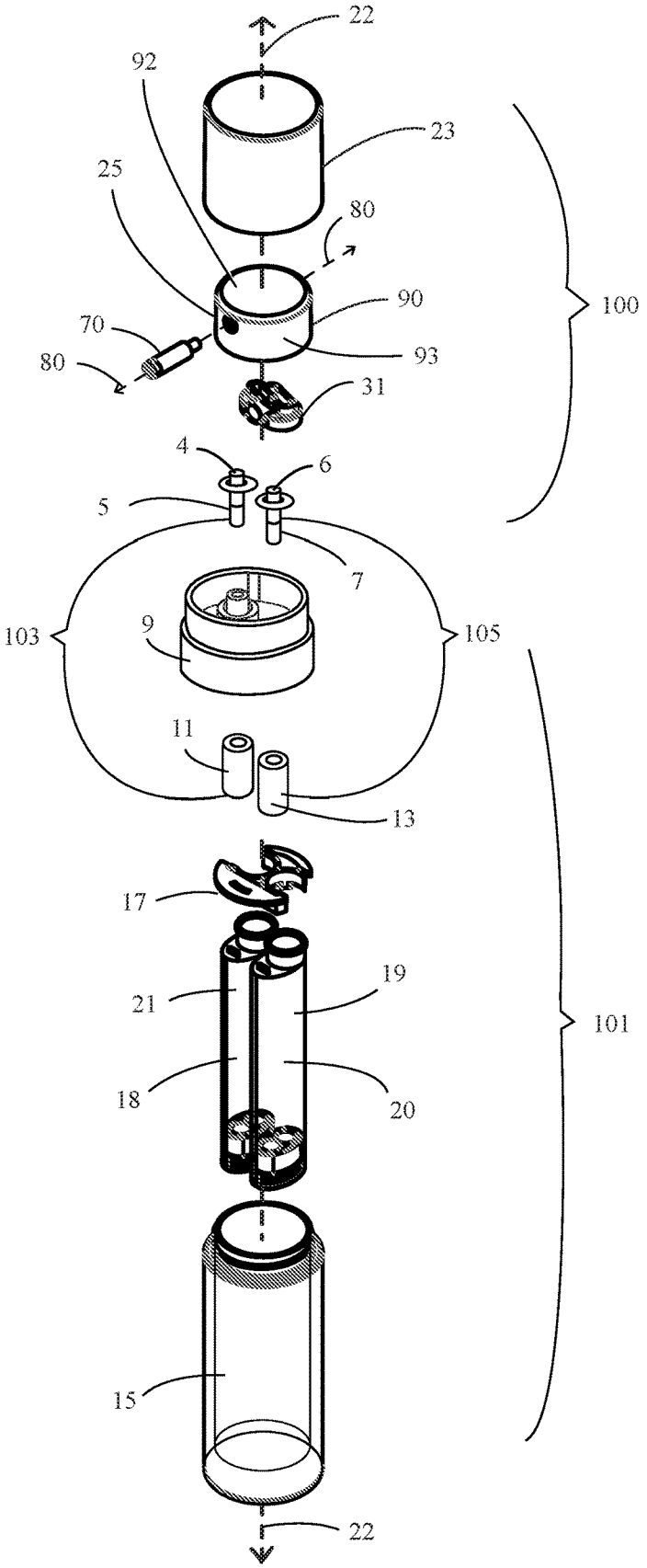
FIG. 2 is an exploded perspective view of the product dispenser of FIG. 1.

FIG. 2 is an exploded perspective view of the product dispenser (1) of previously described FIG. 1. Again, the product longitudinal axis (22) traverses the length of the product dispenser (1). At the upper most portion of the product dispenser (1) is an optional removeable cap (23), which is opposing a housing (15) at the bottom most portion of the product dispenser (1). The removeable cap (23) caps an actuator (90) (inside thereof). In turn, the actuator (90) covers and is functionally attached and/or integral to a multi-composition flow director (31). The actuator (90) has an actuator top wall (92) and circumferentially around the actuator top wall (92) is an actuator outer side wall (93). The actuator outer side wall (93) has a hole, specifically an actuator nozzle hole (93). A nozzle (70) at least partially protrudes through the actuator nozzle hole (93) when the nozzle (70) is functionally attached to the multi-composition flow director (31). The nozzle is positioned along a nozzle longitudinal axis (80) that is preferably in a plane that is orthogonal to the longitudinal product axis (22), more preferably the nozzle longitudinal axis (80) intersects the longitudinal product axis (22). It is the nozzle (70) through which the contained compositions (not shown) are dispensed when the product dispenser (1) is actuated.

Still referring to FIG. 2, the product dispenser (1) comprises at least one pump, preferably a first pump (103) and a second pump (105). In alternative examples, the product dispenser may comprise a single pump that is in fluid communication to a plurality of contained compositions/containers. Or the product dispenser may comprise a plurality of pumps for each respective contained composition/container. Turning to FIG. 2, the first pump (103) is comprised of a first pump cylinder (11) and a functionally received first pump stem (5). Similarly, the second pump (105) is comprised of a second pump cylinder (13) and a functionally received second pump stem (7). The cylinders (11, 13) may each contain a spring that exerts upward force onto the respective pump stems (5, 7). The first pump stem (5) and the second pump stem (7) each have a respective first pump outlet (4) and a second pump outlet (6). These outlets (4, 6) are each in fluid communication with the multi-composition flow director (31). The pump collar (9), previously identified in FIG. 1, may functionally hold the first and second pump cylinders (11, 13) and do so in a manner so these cylinders (11, 13) do move relative to the pump collar (9) when the product dispenser (1) is actuated. Rather, the first pump stem (5) and the second pump stem (5) will move along in an axis (not shown) parallel to the longitudinal product axis (22) when the product dispenser (1) is actuated.

Still referring to FIG. 2 and longitudinally below the first and second pump cylinders (11, 13) (along the longitudinal product axis (22)), is an adapter (17) that adapts the containers (21, 19) into the aforementioned housing (15). That is, the containers (21, 16) are housed within the housing (15). The first pump (103) is in fluid communication with the interior contents of the first container (21) while the second pump (105) is in fluid communication with the interior contents of the second container. Collectively, the pump collar (9), first and second pump cylinders (11, 13), adapter (17), first and second containers (21, 19), and housing form a stationary subassembly (101). This stationary subassembly (101) forms the bottom portion of the product dispenser (1) and remains stationary relative to the opposing (and upper portion) moveable subassembly (100) when the product dispenser (1) is actuated. The actuator (90), nozzle (70), multi-composition flow director (31), and first pump stem (5) and second pump stem (7) collectively form the moveable subassembly (100). The moveable subassembly (100) is mechanically coupled to the stationary subassembly such that it moves when the user actuates the product dispenser (1) to dispense contained compositions within the product dispenser (1). A first composition (18) is contained in the first container (21) and a second composition (20) is contained in the second container (19). It is these compositions (18, 20) that are dispensed by the product dispenser (1). The first and second compositions can be in a variety of weight ratios relative to each other, for example, 4:1 to 1:4, or from 3:1 to 1:1, or from 2:1 to 1:2. A preferred weight ratio of the first and second composition is about 1:1. The product dispenser is designed so that ideally all the contained compositions have the same product life span, i.e., the end of product life will avoid a situation where one container is empty of composition while the other container contains some remainder amount of composition.

Figure 3A:
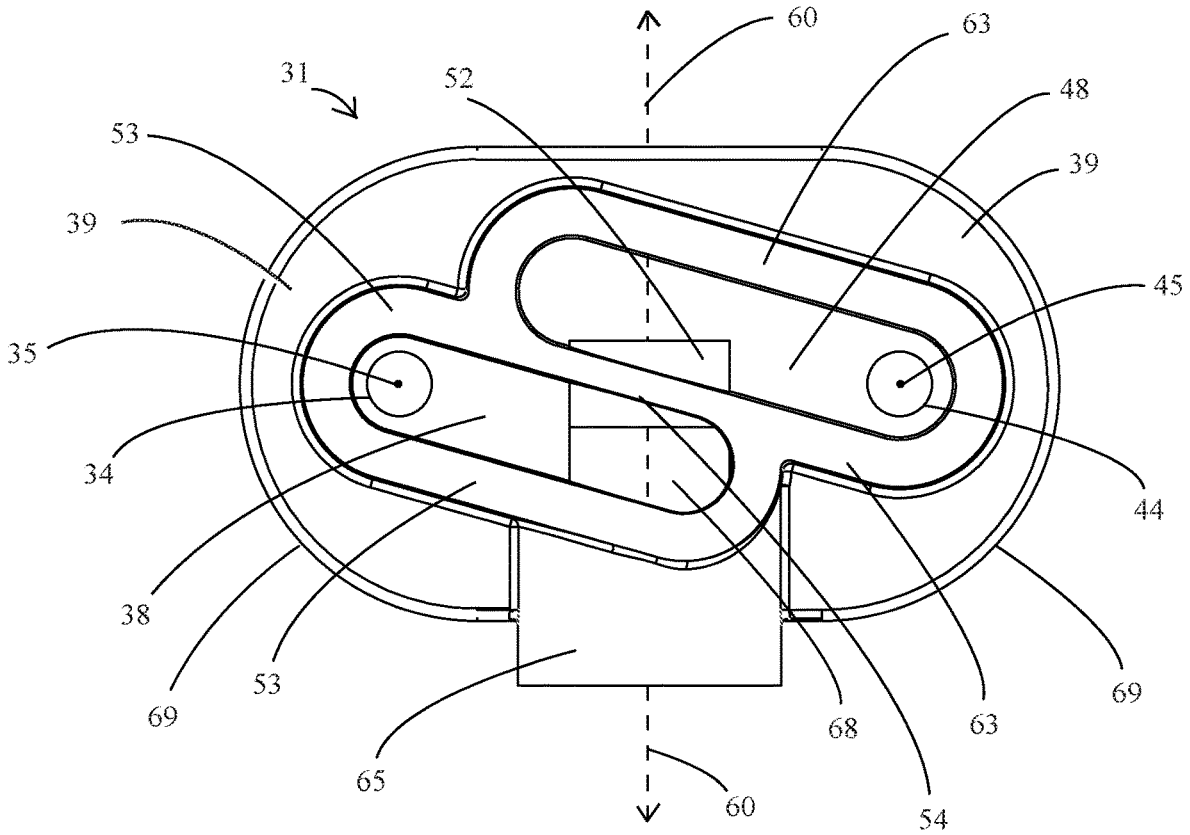
FIG. 3A is a top view of a multi-composition flow director shown in FIG. 2.

FIG. 3A is a top view of a multi-composition flow director (31) of FIG. 2. The multi-composition flow director (31) has a flow director top planar surface (39). Preferably, the flow top planar surface (39) is in a plane orthogonal to the product longitudinal axis (22). A first flow director cavity (38) and a second flow director cavity (48) are generally centrally located in the multi-composition flow director (31). These cavities (38, 48) are adjacent to each other. These cavities (38, 48) are defined, in part, by sharing a first/second shared flow director cavity circumferential wall (54) that projects orthogonally from the flow director top planar surface (39). Referring to the first flow director cavity (38), a first flow director cavity circumferential wall (53) also projects orthogonally from the flow director top planar surface (39) and circumferentially defines the first flow director cavity (38) by connecting on either end of the first/second shared flow director cavity circumferential wall (54). Similarly, referring to second flow director cavity (48), a second flow director cavity circumferential wall (63) also projects orthogonally from the flow director top planar surface (39) and circumferentially defines the second flow director cavity (48) by connecting on either end of the first/second shared flow director cavity circumferential wall (54).

Still referring to FIG. 3A, the multi-composition flow director (31) comprises an outer flow director sealing ring (65) and an inner flow director sealing ring (52). The inner flow director sealing ring (52) is located centrally within the multi-composition flow director (31), while the outer flow director sealing ring (65) is located on the outside of the multi-composition flow director (31), specifically along a long side of the flow director (31). A flow director side wall (69) generally outlines the outer circumference of the multi-composition flow director (31) forming a pill shape outline except for the outer flow director sealing ring (65) which slightly projects (in a plane along the flow director planar surface (39)) from what otherwise would be a generally symmetrical pill shape outline. The outer flow director sealing ring (65) is larger than the inner flow director sealing ring (52). These rings (65, 52) are aligned along an inner/outer flow director sealing ring longitudinal axis (60). The inner flow director sealing ring (52) traverses through the first/second shared flow director cavity circumferential wall.

Without the nozzle (70) functionally attached, (said nozzle not shown in FIG. 3A), the first and second flow director cavities (53, 48) are otherwise in fluid communication with each other via the inner flow director sealing ring (52). In between the inner and outer flow director sealing rings (52, 65) and along the inner/outer flow director sealing ring longitudinal axis (60) there is a circular segmental channel (68). The center point of the radius for the circular segmental channel (68) is along the inner/outer flow director sealing ring longitudinal axis (60). This channel (68) is recessed relative to the flow director top planar surface (39). The first flow direct cavity comprises the circular segmental channel (68) along the inner/outer flow director sealing ring longitudinal axis (60). Preferably a cross section of the circular segmental channel (68) (without nozzle (70) functionally attached to the multi-composition flow director (31)) in a plane orthogonal to and relative to the inner/outer flow director sealing ring longitudinal axis (6), is at least 1 radian, preferably 1 radian to 4 radians, more preferably from 2 to 4 radians, alternatively about 3.14 radians.

Still referring to FIG. 3A, the first flow director cavity (34) has a first cavity inlet planar opening (34). Similarly, the second flow director cavity (48) has a second cavity inlet planar opening (44). These openings (34, 33) are ends of the respective cavities (34, 48) furthest from inner/outer flow director sealing ring longitudinal axis (60) (in a plane along the flow director planar surface (39)). The first cavity inlet planar opening (34) has a first cavity inlet planar opening centroid (35). Through this centroid (35) intersects a first inlet axis (shown in FIG. 3B below). The first inlet axis is orthogonal to the first cavity inlet planar opening (34). Similarly, the second cavity inlet planar opening (44) has a second cavity inlet planar opening centroid (45). Through this centroid (45) intersects a second inlet axis (shown in FIG. 3B below). The second inlet axis is orthogonal to the second cavity inlet planar opening (44).

Figure 3B:
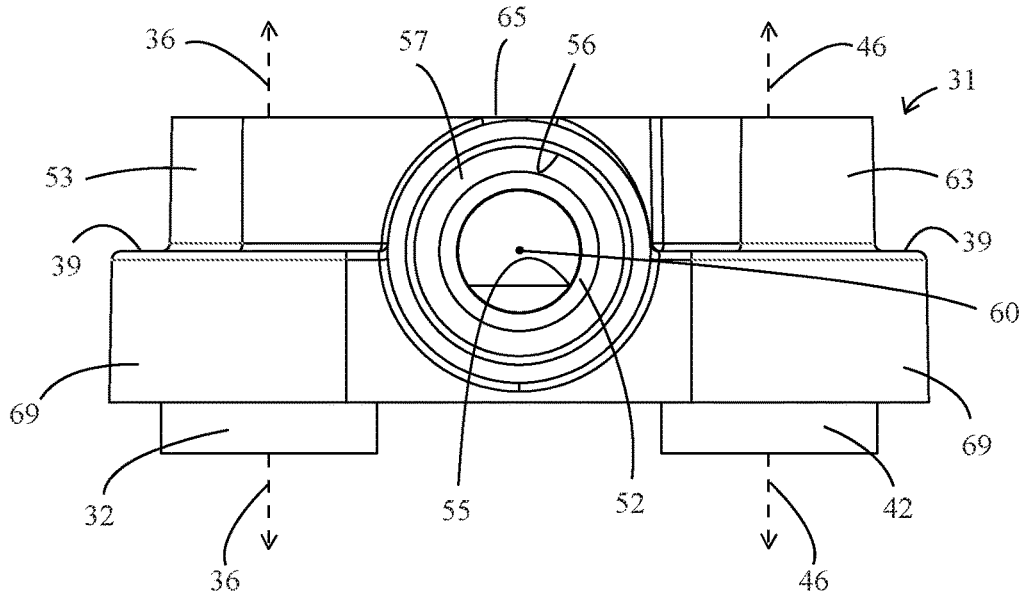
FIG. 3B is a front view of the multi-composition flow director of FIG. 3A.

FIG. 3B is a front view of the multi-composition flow director of FIG. 3A. A first inlet axis (36) intersects first cavity inlet planar opening centroid (not shown, but previously described in FIG. 3A) and similarly a second inlet axis (46) intersects the second cavity inlet planar opening centroid (not shown, but previously described in FIG. 3A). A first flow director receiver (32) projects along the first inlet axis (36) opposing the flow director top planar surface (39). Similarly, a second flow director receiver (42) project along the second inlet axis (46) opposing the flow director top planar surface (39). Although not shown in FIG. 3B, but previously discussed in FIG. 2, the first pump outlet (4) and the first flow director receiver (32) are fluidly sealed (and aligned along the first inlet axis (36)). Similarly, the second pump outlet (6) and the second flow director receiver (42) are fluidly sealed (and aligned along the second inlet axis (46)). The first inlet axis (36) and the second inlet axis (46) are parallel to each other. In turn, preferably the first and second inlet axis (36, 46) are parallel to the product longitudinal axis (22).

Still referring to FIG. 3B, the flow director side wall (69) essentially wraps around the outer periphery of the multi-composition flow director (31). Nearest the first inlet axis (36), opposing the first flow director receiver (32) is a front view of a portion of the first flow director cavity circumferential wall (53). The flow director side wall (69) is in-between the first flow director cavity circumferential wall (53) and the first flow director receiver (32). Similarly, but nearest the second inlet axis (46), and opposing the second flow director receiver (42) is a front view of a portion of the second flow director cavity circumferential wall (63). The flow director side wall (69) is in-between the second flow director cavity circumferential wall (63) and the second flow director receiver (42).

Still referring to FIG. 3B, both the outer and inner flow director sealing rings (65, 52) are shown. In the very center of both rings (65, 52) is the inner/outer flow director sealing ring longitudinal axis (60). The first concentric ring, nearest the inner/outer flow director sealing ring longitudinal axis (60), is the inner flow director sealing ring (52). The inside surface, all the way around the inner flow director sealing ring (52), is the inner flow director sealing ring circumferential surface (55). The minimum inner diameter of the inner flow director sealing ring (52) is 3 mm to 5.5 mm, preferably 3.25 to 5 mm, more preferably 3.5 to 4.5 mm, alternatively about 4 mm, measured in a plane orthogonal the inner/outer flow director sealing ring longitudinal axis (60). The lower portion of inner flow director sealing ring (52) is visible in FIG. 3B because of the circular segmental channel (68) (of the first flow director cavity (38)).

Still referring to FIG. 3B, the next concentric ring further out from the inner flow director sealing ring (52) is an abutment ring portion (57) of the outer flow director sealing ring (65). The minimum inner diameter of the abutment ring portion (57) is 4.25 mm to 7 mm, preferably 4.5 to 6 mm, more preferably 4.75 to 5.5 mm, alternatively about 5 mm, measured in a plane orthogonal the inner/outer flow director sealing ring longitudinal axis (60).

Finally, the last concentric ring is the non-abutment ring portion of the outer flow director sealing ring (65). The inside surface, all the way around the non-abutment ring portion of the outer flow director sealing ring (65), is the outer flow director sealing ring inner circumferential surface (56). The minimum inner diameter of the non-abutment ring portion of the outer flow director sealing ring (65) is 5.5 mm to 8 mm, preferably 5.75 to 7.5 mm, more preferably 6 to 7 mm, alternatively about 6.5 mm, measured in a plane orthogonal the inner/outer flow director sealing ring longitudinal axis (60).

The overall maximum outer diameter of the outer ring is 6.75 mm to 9.5 mm, preferably 7 to 9 mm, more preferably 7.5 to 8.5 mm, alternatively about 8 mm, measuring in a plane intersecting the inner/outer flow director sealing ring longitudinal axis (60). In one example, as shown in FIG. 3B, the maximum outer diameter of the outer flow director sealing ring (65) is such that is essentially the same as the flow director side wall (69) and first and second flow director cavity circumferential walls (53, 63). The ratio of the minimum inner diameter of the non-abutment ring portion of the outer flow director sealing ring (65) and that of the minimum diameter of the inner flow director sealing ring (52) is from 5:4 to 5:2, preferably from 11:4 to 2:1, more preferably from 3:2 to 7:4, alternatively about 13:8. Preferably cross-sectional shape (in a plane orthogonal to the inner/outer flow director sealing ring longitudinal axis (60)) of the abutment ring portion (57) of the outer flow director sealing ring (65), the non-abutment ring portion of the outer flow director sealing ring (65), and the inner flow director sealing ring (52) is each independently selected from a oval or circular (to inter alia achieve a good seal contact pressure with the nozzle conduits).

Still referring to FIG. 3B, inner/outer flow director sealing ring longitudinal axis (60) is essentially parallel to a plane along the flow director planar surface (39), and wherein said plane is orthogonal to the first and second inlet axis (36, 46). In one example, an inlet intersecting plane intersects the first cavity inlet axis (36) and the second cavity inlet axis (46), and the inner/outer flow director sealing ring longitudinal axis (60) intersects said plane to form an angle from 60 degrees to 90 degrees, preferably 70-90 degrees, more preferably 80-90 degrees, yet more preferably 90 degrees (i.e., that inner/outer flow director sealing ring longitudinal axis (60) is orthogonal from said inlet intersecting plane). Although not shown FIGS. 3A and 3B, when the nozzle (7) is functionally attached to the multi-composition flow director (31) (through the outer and inner flow director sealing ring (65, 52)), the nozzle longitudinal axis (80) and the inner/outer flow director sealing ring longitudinal axis (60) align (i.e., these axis (80, 60) are one in the same).

Figure 4A:
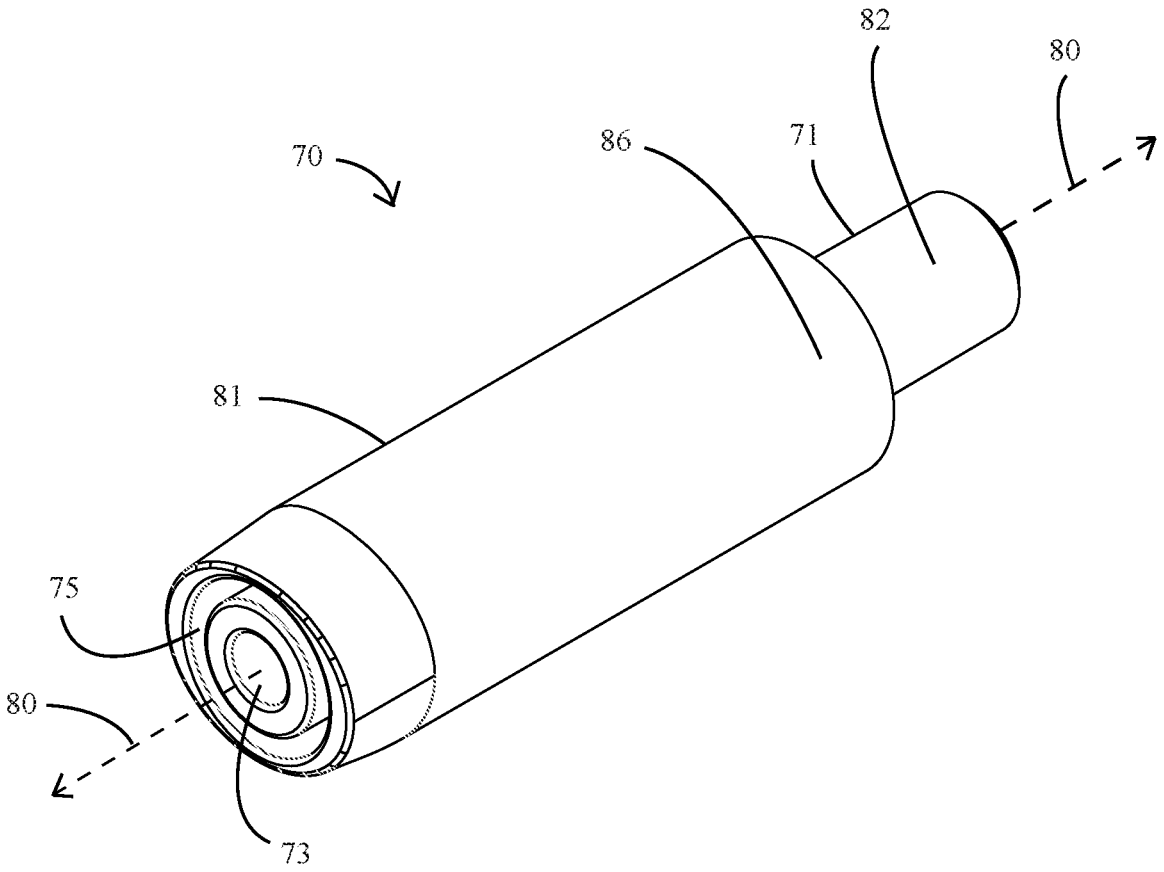
FIG. 4A is left perspective view of the nozzle shown in FIG. 2.

Referring to FIG. 4A is left perspective view of the nozzle (70) of FIG. 2 with the front of the nozzle (70) visible. A nozzle longitudinal axis (80) passes along the center and length of the nozzle (7) and through the inner nozzle conduit outlet opening (75). The nozzle longitudinal axis (80) intersects centroids (not shown) in cross sectional orthogonal planes on opposing ends of the inner nozzle conduit (71). The outer nozzle conduit outlet opening (75) is concentrically outward from the inner nozzle conduit (71) (relative to the nozzle longitudinal axis (80)). The inner nozzle conduit (71) is in fluid communication with the second flow director cavity (not shown). The outer nozzle conduit (81) is in fluid communication with the first flow director cavity (not shown). The outer nozzle conduit (81) at least partially extends, preferably fully extends, circumferentially around the inner nozzle conduit (71). There may be one, two, or more interconduit support ribs (87) providing support between the outer and inner nozzle conduits (81, 71).

The length of inner nozzle conduit (81) is longer than the length outer nozzle conduit (81) (measured along the nozzle longitudinal axis (80)). Consequently, the inner nozzle conduit outer circumferential surface (82), of the inner nozzle conduit (71) that extends beyond the outer nozzle conduit (81), is exposed (when the nozzle (70) is not functionally attached). The outer nozzle conduit outer circumferential surface (86) of the outer nozzle conduit (81) is exposed (when the nozzle (70) is not functionally attached). When the nozzle (70) is functionally attached to the multi-compositional flow director (not shown in FIG. 4A), it is the inner nozzle conduit outlet opening (73) and the outer nozzle conduit outlet opening (75) that are externally exposed.

Figure 4B:
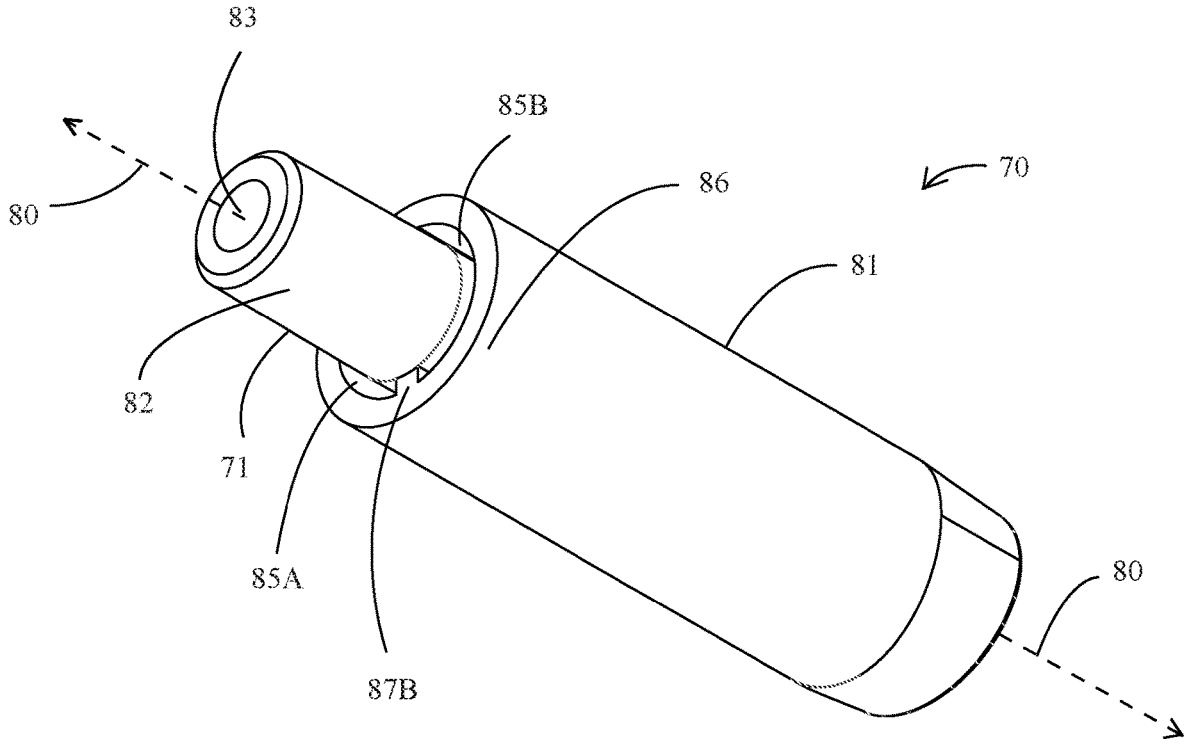
FIG. 4B is a right perspective view of the nozzle of FIG. 4A.

FIG. 4B is a right perspective view of the nozzle (70) of FIG. 4A with the back of the nozzle (70) visible. The nozzle longitudinal axis (80) passes along the center and length of the nozzle (70) and through the inner nozzle conduit inlet opening (83). The inner nozzle conduit inlet opening (83) opposes the inner nozzle conduit outlet opening (73). An outer nozzle conduit inlet opening(s) (85A, 85B) are concentrically outward from the inner nozzle conduit (71) (relative to the nozzle longitudinal axis (80)). The outer nozzle conduit inlet openings (85A, 85B) are opposing the outer nozzle conduit outlet opening (75). The interconduit support rib(s) (87) provide support between the outer nozzle conduit (81) and the inner nozzle conduit (82). The second interconduit support rib (87B) is visible in FIG. 4B. The interconduit support rib(s) (87) can be partially, intermittently, and/or along the entire length of the nozzle (70). The inner nozzle conduit outer circumferential surface (82), of the inner nozzle conduit (71) that extends beyond the outer nozzle conduit (81), is exposed. The outer nozzle conduit outer circumferential surface (86) of the outer nozzle conduit (81) is exposed. In one example, the length of the outer nozzle conduit (81) is from 30% to 99%, preferably from 40% to 90%, more preferably from 50% to 80%, of the length of the inner nozzle conduit (71) (measured in a plane along the nozzle longitudinal axis (80)).

Figure 4C:
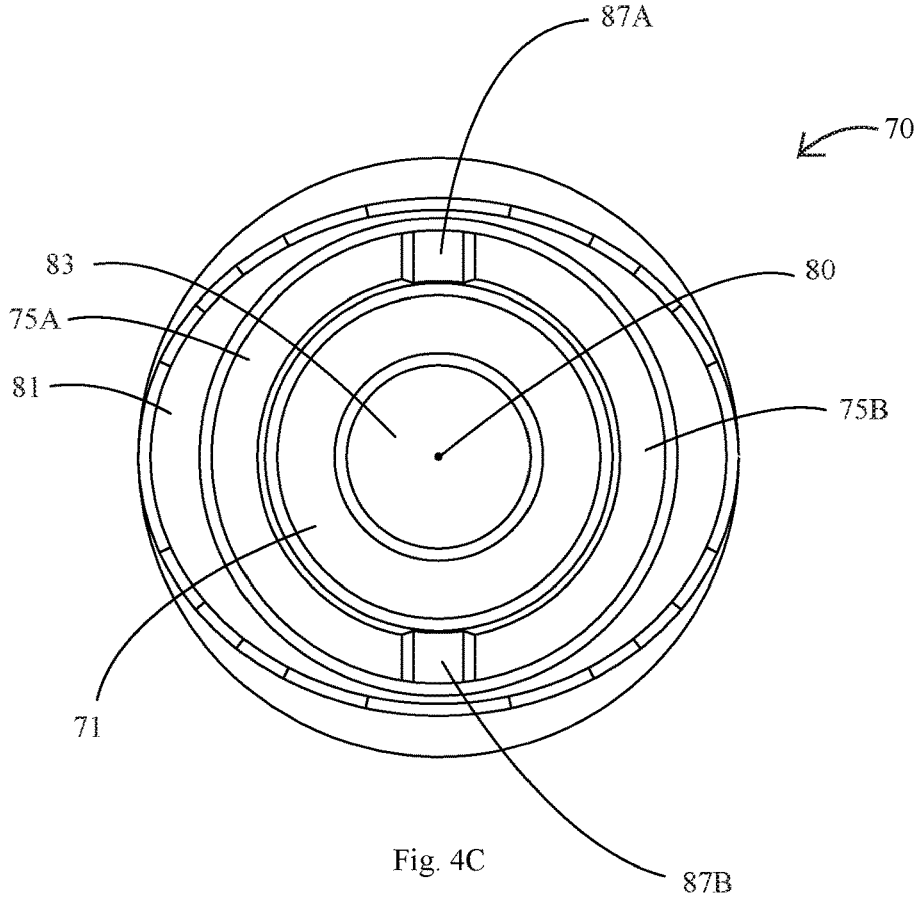
FIG. 4C is a front view of the nozzle of FIG. 4A.
Figure 4D:
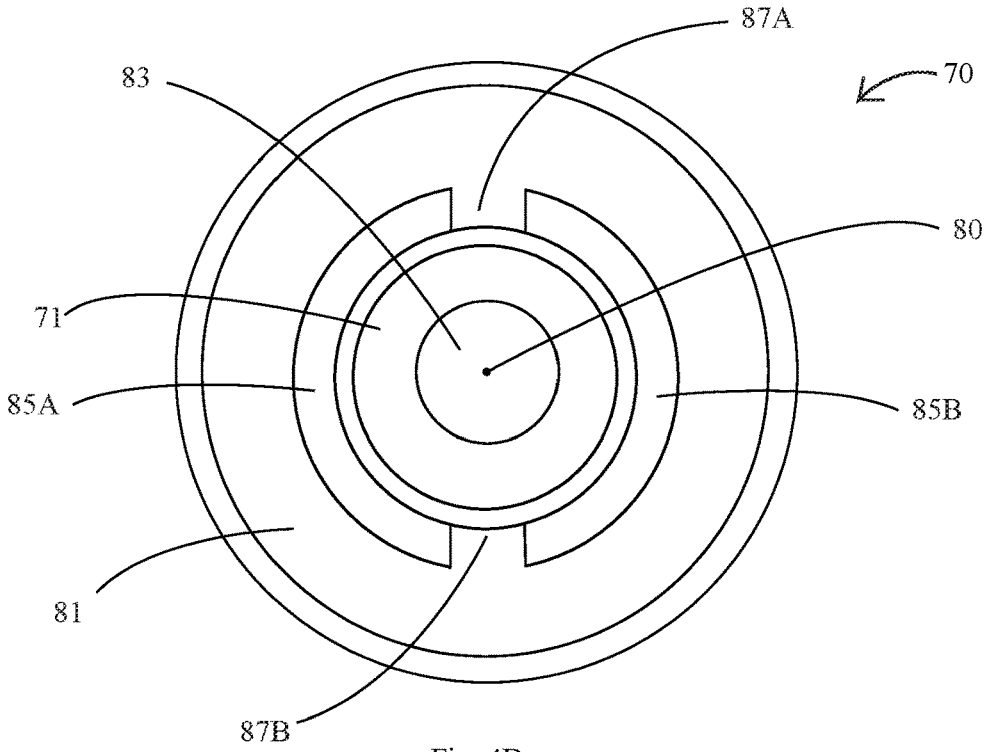
FIG. 4D is a back view of the nozzle of FIG. 4A.

FIG. 4C is a front view of the nozzle (70) of FIG. 4A. The nozzle longitudinal axis (80) is the in the center of the nozzle (70) and inner nozzle conduit (71). Concentrically outward from the inner nozzle conduit (71) (relative to the nozzle longitudinal axis (80)) is the outer nozzle conduit (81). The first and second interconduit support ribs (87A and 87B, respectively) provide support between the outer and inner nozzle conduits (81, 82), and bifurcate the outer nozzle conduit outlet opening (75A, 75B). FIG. 4D is a back view of the nozzle (70) of FIG. 4A, and is the opposing view of FIG. 4C. The nozzle longitudinal axis (80) is the in the center of the nozzle (70) and the inner nozzle conduit (71). Concentrically outward from the inner nozzle conduit (71) (relative to the nozzle longitudinal axis (80)) is the outer nozzle conduit (81). The first and second interconduit support ribs (87A and 87B, respectively) provide support between the outer and inner nozzle conduits (81, 82), and bifurcate the outer nozzle conduit inlet opening (85A, 85B).

The nozzle (70) described here can be manufactured using a simple straight-pull mold. Two core inserts building the outer and inner nozzle conduits (81, 82) are fully supported. This allows for reducing conduit wall thickness while minimizing the risk of the core shifting.

Figure 5A:
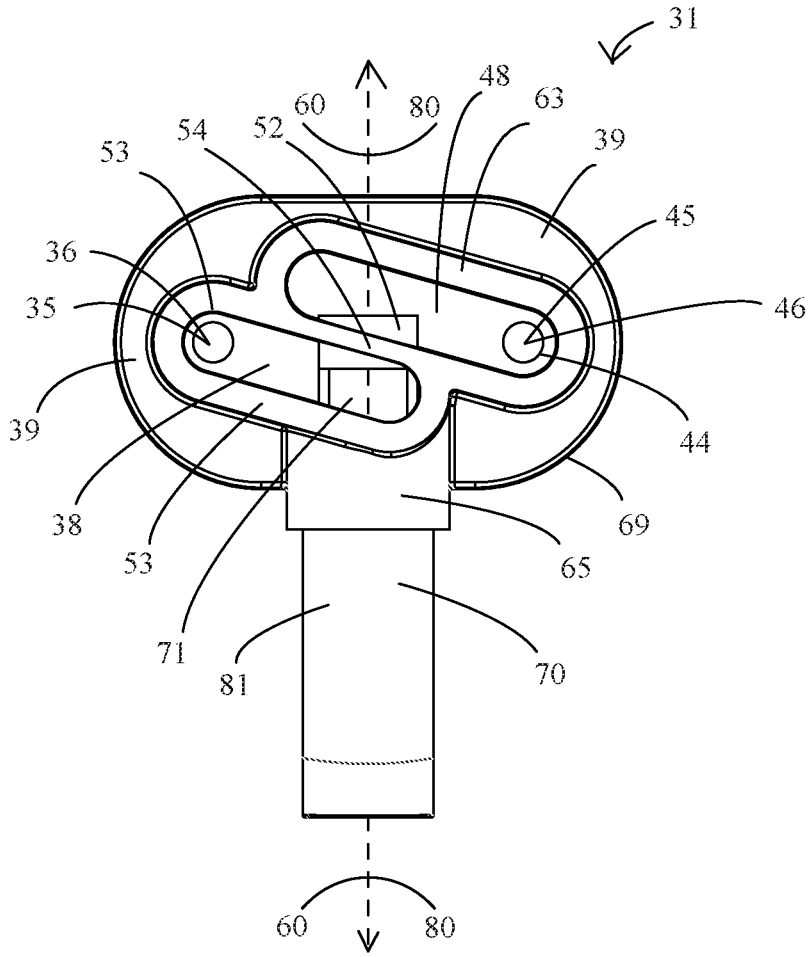
FIG. 5A is a top view of the nozzle functionally attached to the multi-composition flow director of FIGS. 4A and 3A, respectively.
Figure 5B:
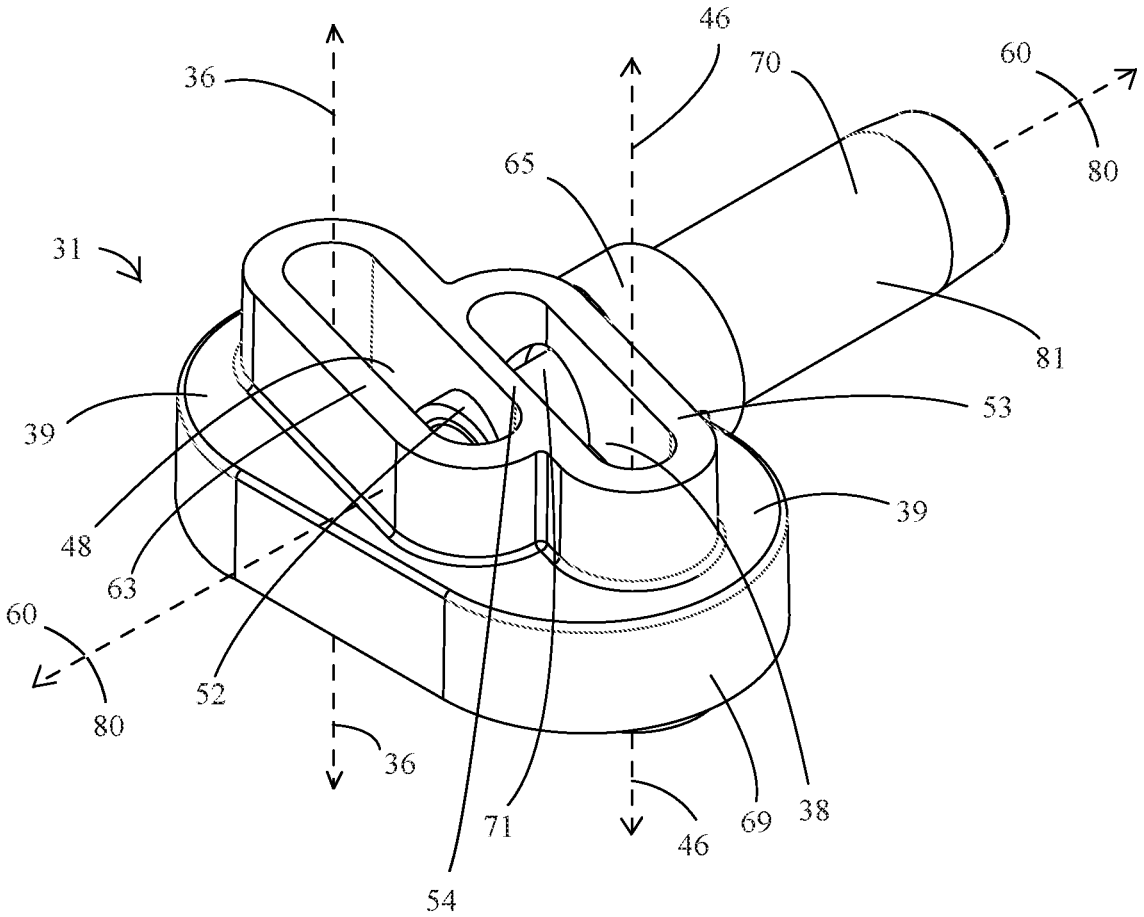
FIG. 5B is a perspective view of the nozzle functionally attached to the multi-composition flow director of FIG. 5A.

FIG. 5A is a top view of the nozzle (70) functionally attached to the multi-composition flow director (31) of FIGS. 4A and 3A, respectively. And FIG. 5B is a perspective view of the nozzle functionally attached to the multi-composition flow director of FIG. 5A. The flow multi-composition flow director (31) has a flow director top planar surface (39). A first flow director cavity (38) and a second flow director cavity (48) are generally centrally located in the multi-composition flow director (31). These cavities (38, 48) are adjacent to each other. These cavities (38, 48) are defined, in part, by sharing a first/second shared flow director cavity circumferential wall (54) that project orthogonally from the flow director top planar surface (39). Referring to the first flow director cavity (38), a first flow director cavity circumferential wall (53) also projects orthogonally from the flow director top planar surface (39) and circumferentially defines the first flow director cavity (38) by connecting on either end of the first/second shared flow director cavity circumferential wall (54). Similarly, referring to second flow director cavity (48), a second flow director cavity circumferential wall (63) also projects orthogonally from the flow director top planar surface (39) and circumferentially defines the second flow director cavity (48) by connecting on either end of the first/second shared flow director cavity circumferential wall (54).

Still referring to FIGS. 5A and 5B, the multi-composition flow director (31) comprises a outer flow director sealing ring (65) and an inner flow director sealing ring (52). The inner flow director sealing ring (54) is located centrally within the multi-composition flow director (31), while the outer flow director sealing ring (65) is located on the outside of the multi-composition flow director (31), specifically along a long side of the flow director (31). A flow director side wall (69) generally outlines the outer circumference of the multi-composition flow director (31) forming a pill shape outline except for the outer flow director sealing ring (65) which slightly projects (in a plane along the flow director planar surface (39)) from what otherwise would be a generally symmetrical pill shape outline. The outer flow director sealing ring (65) is generally larger (i.e., greater diameter) than the inner flow director sealing ring (52) and that of the outer nozzle conduit (81) of the nozzle (70). For clarification the inner/outer flow director sealing ring longitudinal axis (6) and the nozzle longitudinal axis (80) are one in the same for purposes of FIGS. 5A and 5B (and thus are used interchangeably). Accordingly, the outer and inner flow director sealing rings (65 and 52, respectively) are aligned along the inner/outer flow director sealing ring longitudinal axis (6) and the nozzle longitudinal axis (80). The outer nozzle conduit (81) has a larger diameter than the inner flow director sealing ring (52). The inner flow director sealing ring (52) traverses through the first/second shared flow director cavity circumferential wall. With the nozzle (70) functionally attached, the first and second flow director cavities (53, 48) are not in fluid communication with each other (as described earlier in FIGS. 3A and 3B without the nozzle (70)). In-between the inner and outer flow director sealing rings (52, 65) and along the inner/outer flow director sealing ring longitudinal axis (60) there is a circular segmental channel (68). When the nozzle (70) is functionally attached, this channel (68) is now occupied, in part, by the inner nozzle conduit (71).

Still referring to FIGS. 5A and 5B, the first flow director cavity (34) has a first cavity inlet planar opening (34). Similarly, the second flow director cavity (48) has a second cavity inlet planar opening (44). These openings (34, 33) are ends of the respective cavities (34, 48) furthest from inner/outer flow director sealing ring longitudinal axis (60)/the nozzle longitudinal axis (80) (in a plane along the flow director planar surface (39)). The first cavity inlet planar opening (34) has a first cavity inlet planar opening centroid (35). Through this centroid (35) intersects a first inlet axis (36). The first inlet axis (36) is orthogonal to the first cavity inlet planar opening (34). Similarly, the second cavity inlet planar opening (44) has a second cavity inlet planar opening centroid (45). Through this centroid (45) intersects a second inlet axis (46). The second inlet axis (46) is orthogonal to the second cavity inlet planar opening (44).

The inner nozzle conduit (71), of the functionally attached nozzle (70), is in fluid communication with the second flow director cavity (48) and is fluidly sealed against the inner flow director sealing ring (52). The outer nozzle conduit (81), of the functionally attached nozzle (70), is in fluid communication with the first flow director cavity (38) and is fluidly sealed against the outer flow director sealing ring (65). The inner nozzle conduit (71) is longer than the outer nozzle conduit (81). The fluid seal between the inner nozzle conduit (71) and the inner flow director sealing ring (52) is formed between an inner nozzle conduit outer circumferential surface (82) and an inner flow director sealing ring inner circumferential surface (55). For example, 3% to 30%, preferably from 5% to 25%, more preferably 10% to 20%, (e.g., about 16%), of the total length of the nozzle (70), measured along a nozzle longitudinal axis (80), forms the fluid seal between the inner nozzle conduit (71) and the inner flow director sealing ring (52). The fluid seal of the outer nozzle conduit (81) and the outer flow director sealing ring (65) is formed between an outer nozzle conduit outer circumferential surface (86) and an outer flow director sealing ring inner circumferential surface (56). For example, from 10% to 50%, preferably from 20% to 40%, more preferably from 25% to 35% (e.g., about 28%), of the total length of the nozzle (70), measured along a nozzle longitudinal axis (80), forms the fluid seal between the outer nozzle conduit (81) and the outer flow director sealing ring (65). In one specific example, the fluid seal of the outer nozzle conduit (81) and the outer flow director sealing ring (65) is formed to include at least a midpoint of the total length of the nozzle (70) (said length measured along a nozzle longitudinal axis (80)).

Figure 6A:
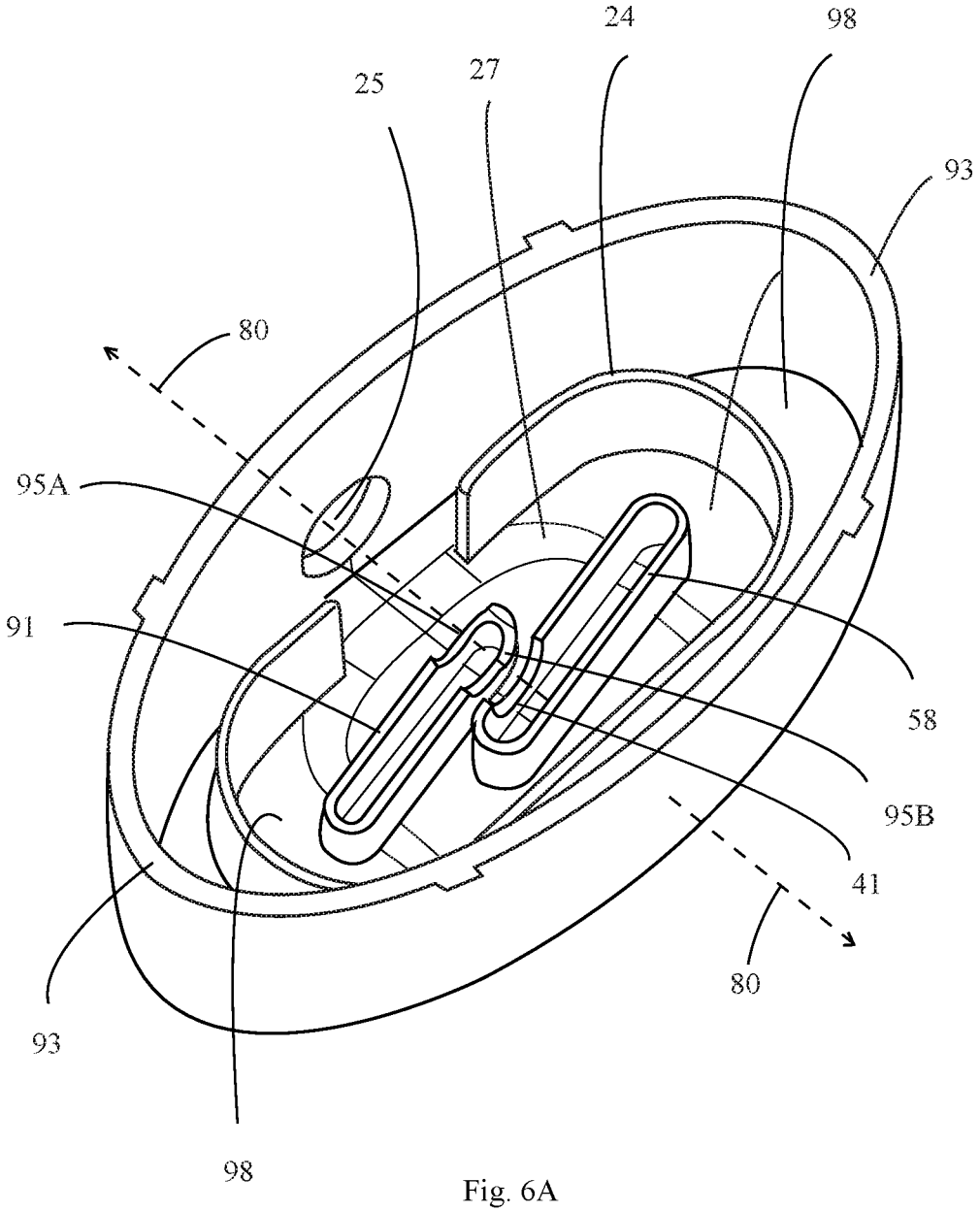
FIG. 6A is perspective view inside of an actuator of FIG. 2.
Figure 6B:
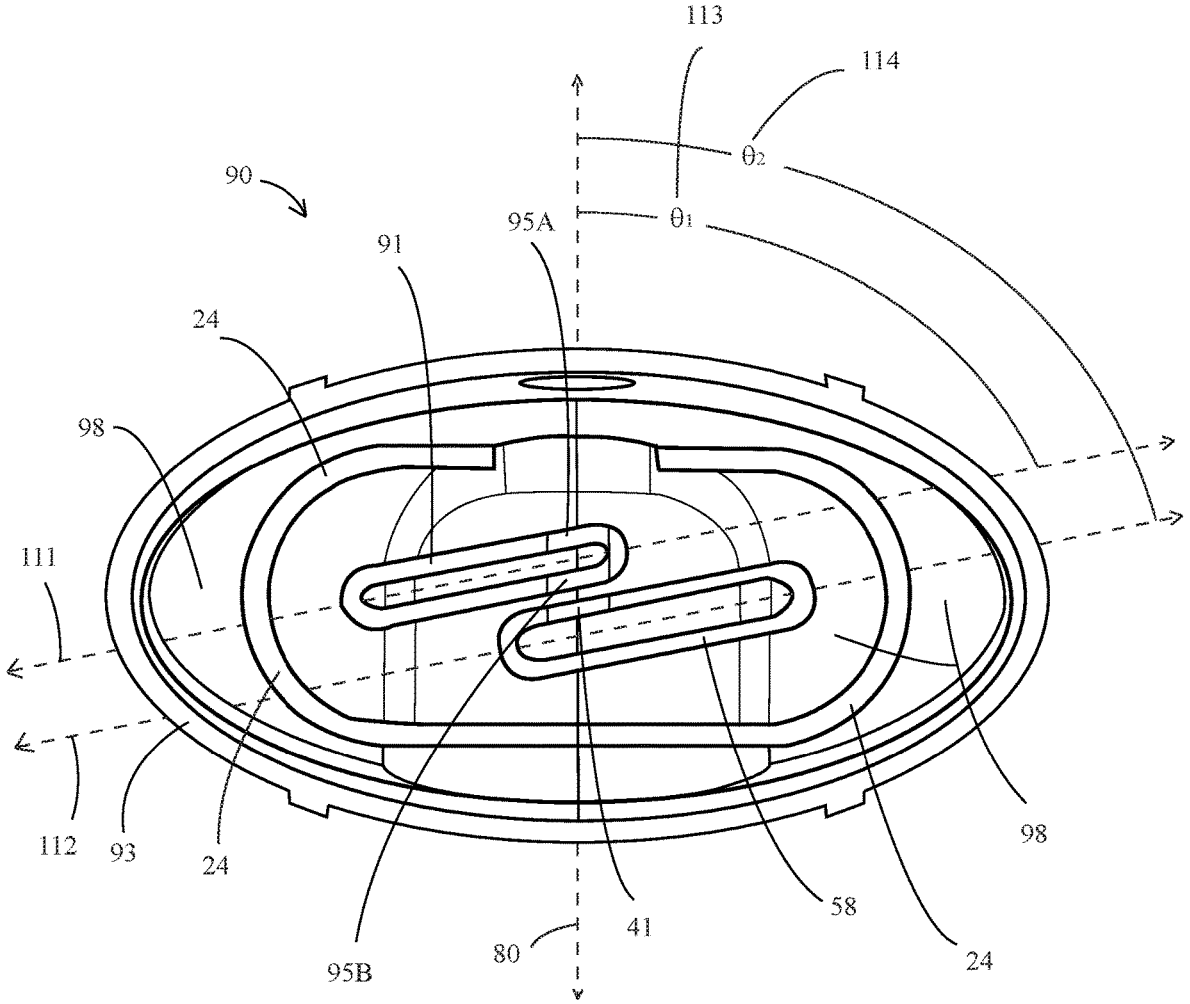
FIG. 6B is a top view of the actuator of FIG. 6A.

FIG. 6A is perspective view inside of the actuator (24) of FIG. 2. FIG. 6B is a top view of the actuator of FIG. 6A. Collectively referring to FIGS. 6A and 6B, the outer perimeter of the actuator (24) is defined by an actuator outer side wall (93) projecting orthogonally from an actuator top wall inner surface (98). An actuator nozzle hole (25) is in the outer perimeter of the actuator (24) where the nozzle protrudes therefrom (not shown). A nozzle longitudinal axis (8) intersects through the middle of the actuator nozzle hole (25). Concentrically inward from the actuator outer side wall (93) is an actuator flow director circumferential wall (24) that also projects orthogonally from the actuator top wall inner surface (98). Although not shown in FIGS. 6A and 6B, the multi-composition flow director (31) and actuator (24) functionally attach to each other within the concentrically defined interior space defined by the actuator flow director circumferential wall (24). The actuator flow director circumferential wall (24) is almost continuous but nearest the actuator nozzle hole (25). Further details regarding this aspect are provided below (when referring to FIG. 7B), but essentially the actuator flow director circumferential wall (24) is discontinuous to provide space for the outer flow director sealing ring (not shown) and the nozzle (not shown) when said ring and nozzle are ultimately functionally attached to the actuator (24). Concentrically inward from the actuator flow director circumferential wall (24) are an actuator first cavity circumferential wall (91) and an actuator second cavity circumferential wall (58), which both project orthogonally from the actuator top wall inner surface (98) and are each continuous generally in an elongated pill form (mirroring the shape of the first and second flow director cavities (38, 48) of the multi-compositional flow director (31), which are not shown in FIGS. 6A and 6B). Although not shown in FIGS. 6A and 6B, the actuator first cavity circumferential wall (91) and the actuator second cavity circumferential wall (58) functionally attach within the first and second flow director cavities (38, 48) of the multi-composition flow director (31). The actuator first cavity circumferential wall (91) is closest to the actuator nozzle hold (25), along the nozzle longitudinal axis (80), relative to the actuator second cavity circumferential wall (58). The actuator first cavity circumferential wall (91) has a first notch of actuator first cavity circumferential wall (95A) and a second notch of actuator first cavity circumferential wall (95B), wherein said notches (95A, 95B) having a circular segmental profile. The center point of the radius for the segmental profile is generally along the nozzle longitudinal axis (80). Although not shown in FIGS. 6A and 6B, the first notch of actuator first cavity circumferential wall (95A) contacts the inner nozzle conduit outer circumferential surface (82) when the nozzle (70) and multi-compositional flow director (31) are functionally attached to the actuator (90). Also not shown, the second notch of actuator first cavity circumferential wall (95B) contacts the inner flow director sealing ring (52) (that protrudes into the first flow director cavity (38)) when the nozzle (70) and multi-compositional flow director (31) are functionally attached to the actuator (90). An actuator first cavity circumferential wall longitudinal axis (111) is along the length (i.e., longest dimension) of the actuator first cavity circumferential wall (91). Similarly, an actuator second cavity circumferential wall longitudinal axis (112) is along the length (i.e., longest dimension) of the actuator second cavity circumferential wall (58). Referencing FIG. 6B, a first angle theta (113) is formed between the nozzle longitudinal axis (80) and the actuator first cavity circumferential wall longitudinal axis (111). This first angle theta (113) is preferably less than 90 degrees, more preferably 60 to 86 degrees, even more preferably from 70 to 82 degrees, alternatively about 78 degrees. Similarly, a second angle theta (112) is formed between the nozzle longitudinal axis (80) and the actuator second cavity circumferential wall longitudinal axis (112). This second angle theta (114) is preferably less than 90 degrees, more preferably 60 to 86 degrees, even more preferably from 70 to 82 degrees, alternatively about 78 degrees. In a preferred example, the first angle theta (113) and second angle theta (114) each have the same angle. The first and second flow director cavities (38, 48) (and the actuator first cavity circumferential wall (91) and the actuator second cavity circumferential wall (58) functionally attached herein) have a straight flow path layout. Such a layout can be advantageous is that it can help keep a robust seal even if there is some degree of warpage that may happen as part of the injunction molding process. Furthermore, having first and second theta angles less than 90 degrees also helps with the flow rate path minimize turbulence/pressure build up that may have otherwise be present in an angle of 90 degrees (or greater). The underside of the visual demarcation (27), on the actuator top wall inner surface (98), is shown.

Figure 7A:
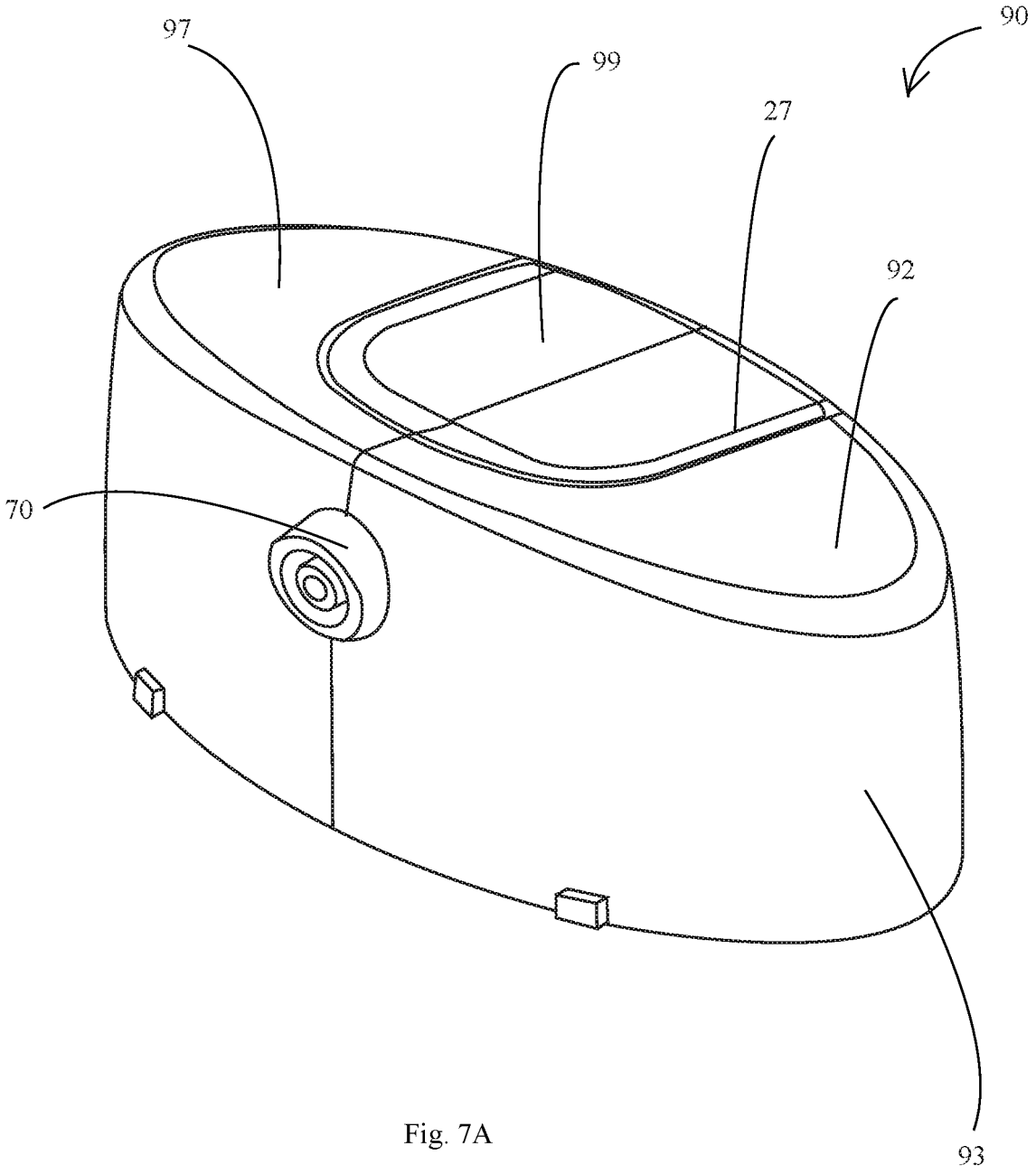
FIG. 7A is a perspective view outside of an actuator of FIG. 6A with the nozzle and multi-composition flow director of FIG. 5A attached.

FIG. 7A is a perspective view external surface of the actuator (90) of FIG. 6A with the nozzle (70) and multi-composition flow director (not shown) of FIG. 5A functionally attached. The actuator (90) covers the multi-composition flow director (3) and preferably at least partially covers the nozzle (70). An actuator top wall outer surface (97) is at the top of the actuator (90) and is surrounded laterally by an actuator outer side wall (93). A portion of the nozzle (70) protrudes through the actuator outer side wall (93) (through the previously described actuator nozzle hole (25)). Preferably the nozzle (70) protrudes out from the actuator outer side wall (93) from 1 mm to 3 mm, preferably from 1.5 mm to 2.5 mm, measured along the nozzle longitudinal axis (80). Without wishing to be bound by theory, this length of protrusion balances the need for the nozzle to protrude out far enough to avoid the dispensing compositions from being contaminated by the actuator outer wide wall (93) but also not so far as to interfere with correct dispensing ergonomics and/or placement of the removeable cap. Preferably the length of the nozzle (70) is greater than 50%, preferably greater than 55%, more preferably between 55% and 80%, yet more preferably 60% to 70% of the width of the actuator (90) measured along the nozzle longitudinal axis (80) and with the nozzle (70) functionally attached. Referring to the actuator top wall (92) visual demarcation (27) indicates to the user where best to push the press-able button (99). It is the press-able button (99) that a user would press to actuate the product dispenser (1). The press-able button (99) is in mechanical communication with the pump(s) (103, 105). A discrete product is dispensed from the product dispenser (wherein the discrete products is comprised of the compositions dispensed from the dispenser).

Figure 7B:
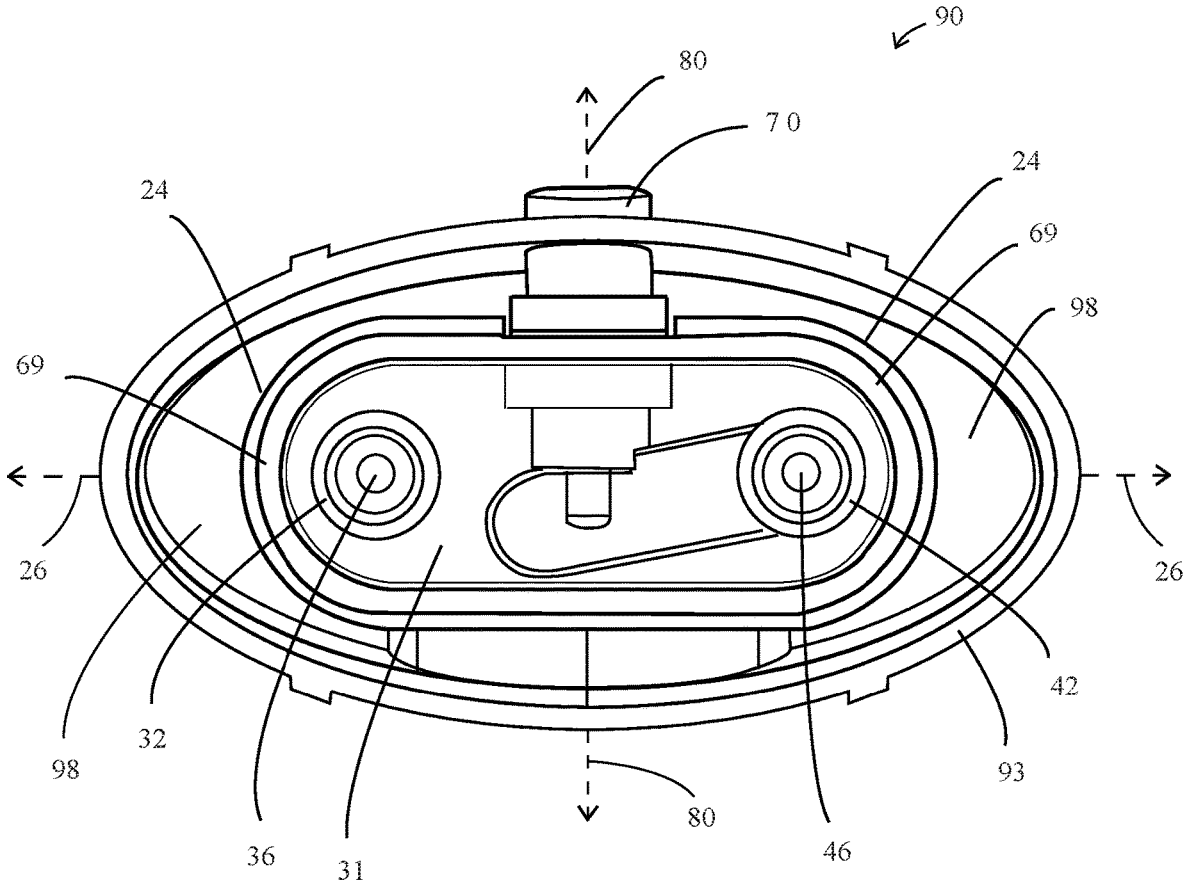
FIG. 7B is a bottom view (inside) of any actuator/nozzle/multi-composition flow director of FIG. 7A.

FIG. 7B is a bottom view (i.e., internal view) of the actuator (90) having the nozzle (70) and multi-composition flow director (31) functionally attached (as described earlier in FIG. 7A). The outer perimeter of the actuator (24) is defined by an actuator outer side wall (93) projecting orthogonally from an actuator top wall inner surface (98). An actuator nozzle hole (25) is in the outer perimeter of the actuator (24) where the nozzle (70) protrudes therefrom. A nozzle longitudinal axis (8) intersects through the middle of the actuator nozzle hole (25) and the nozzle (70). Concentrically inward from the actuator outer side wall (93) is an actuator flow director circumferential wall (24) that also projects orthogonally from the actuator top wall inner surface (98). The multi-composition flow director (31) and actuator (24) functionally attach to each other within the concentrically defined interior space defined by the actuator flow director circumferential wall (24). The outer surface of the flow director side wall (69) contacts the concentrically facing inward surface of the actuator flow director circumferential wall (24). When functionally connected, the flow director top planar surface (39) (of the multi-compositional flow director (31)) and the actuator top wall inner surface (98) (of the actuator (90)) are facing each other, i.e., are contacting each other. On either side of the multi-composition flow director, is the first flow director receiver (32) and a first cavity inlet axis (36) projecting orthogonally therefrom, and the second flow director receiver (42) and a second cavity inlet axis (46) projecting orthogonally therefrom. An inlet intersecting plane (26) intersects the first cavity inlet axis (36) and the second cavity inlet axis (46). The nozzle longitudinal axis (80) intersects said plane to form an angle from 60 degrees to 90 degrees, preferably from 80 degrees to 90 degrees. In one preferred example, the angle is 90 degrees (i.e., the nozzle longitudinal axis (8) is orthogonal from the inlet intersecting plane (26)).

Figure 8A:
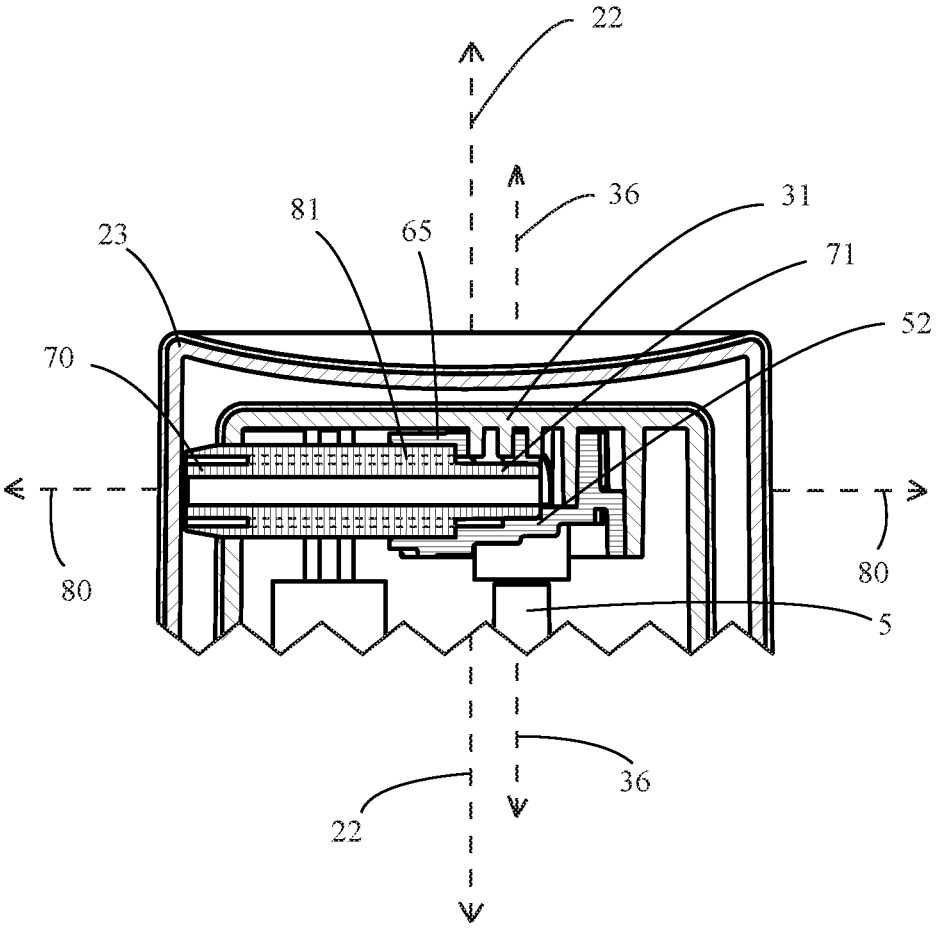
FIG. 8A is a cross sectional view of the product dispenser of FIG. 2, wherein the cross section is taken along the nozzle longitudinal axis that includes a nozzle that is functionally attached into multi-composition flow director.
Figure 8B:
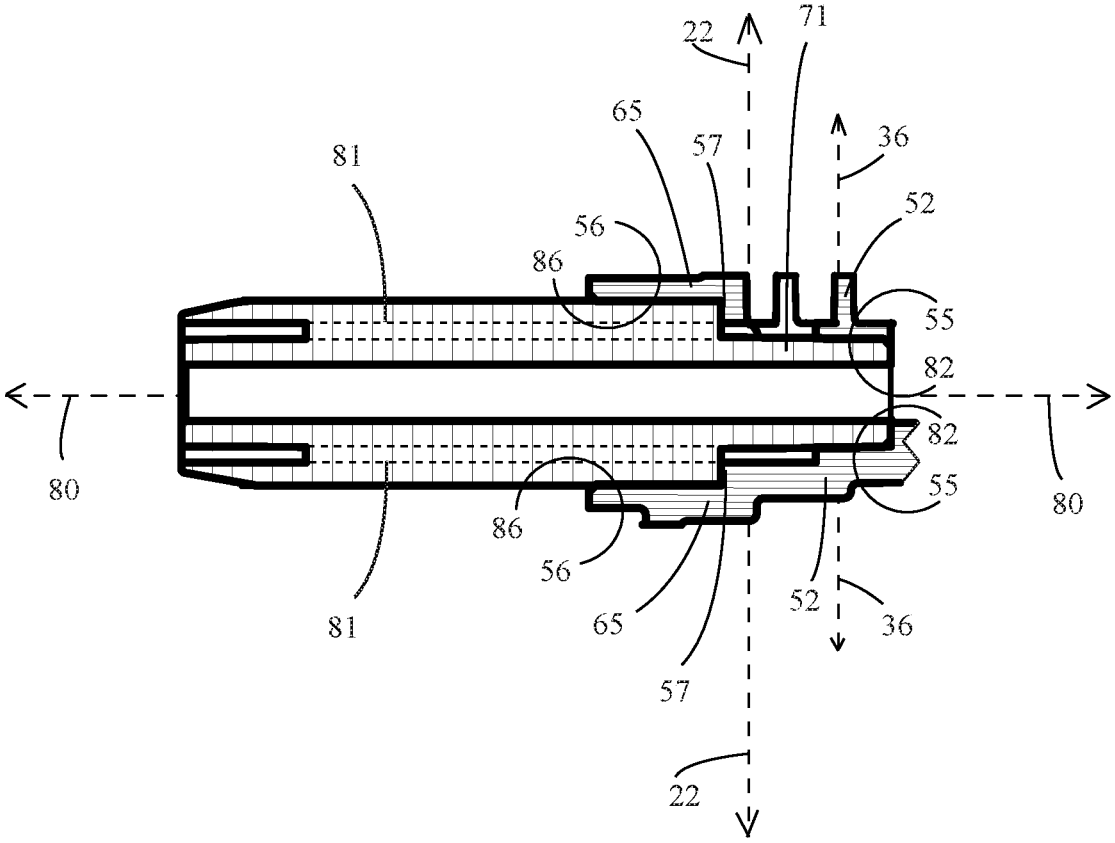
FIG. 8B is an enlarged view of a portion of FIG. 8A.

FIG. 8A is a cross sectional view of the product dispenser (1) of FIG. 2, wherein the cross section is taken along the nozzle longitudinal axis (80) that includes a nozzle (70) that is functionally attached to the multi-composition flow director (31). In this example, the nozzle longitudinal axis (8) orthogonally intersects the longitudinal product axis (22). The first inlet axis (36) (and second inlet axis (not shown)) is parallel to the longitudinal product axis (22). FIG. 8B is an enlarged view of a portion of FIG. 8A focusing on the functionally attached nozzle (70) and the outer and inner flow director sealing rings (65, 52 respectively). The nozzle (70) comprises an inner nozzle conduit (71) and an outer nozzle conduit (81). The flow path through the outer nozzle conduit is not shown because the cross section is taken through opposing first and second interconduit support ribs (87); however it is indicated by dashed line what otherwise would be the flow path through the outer nozzle conduit (81). The inner nozzle conduit (71) is fluidly sealed against the inner flow director sealing ring (52). Preferably the fluid seal between the inner nozzle conduit (71) and the inner flow director sealing ring (52) is formed between an inner nozzle conduit outer circumferential surface (82) and an inner flow director sealing ring inner circumferential surface (55). Preferably from 3% to 30%, preferably from 5% to 25%, more preferably 10% to 20%, alternatively about 16%, of the total length of the nozzle (70), measured along a nozzle longitudinal axis (80), forms the fluid seal between the inner nozzle conduit (71) and the inner flow director sealing ring (52).

Still referring to FIGS. 8A and 8B, the outer nozzle conduit (81) at least partially extends around the inner conduit (71), and the outer nozzle conduit (81) is fluidly sealed against the outer flow director sealing ring (65). Preferably the fluid seal of the outer nozzle conduit (81) and the outer flow director sealing ring (65) is formed between an outer nozzle conduit outer circumferential surface (86) and an outer flow director sealing ring inner circumferential surface (56). Preferably from 10% to 50%, preferably from 20% to 40%, more preferably from 25% to 35%, alternatively about 28%, of the total length of the nozzle (70), measured along a nozzle longitudinal axis (80), forms the fluid seal between the outer nozzle conduit (81) and the outer flow director sealing ring (65). In one example, the fluid seal of the outer nozzle conduit (81) and the outer flow director sealing ring (65) is formed to include at least a midpoint of the total length of the nozzle (70), said length measured along a nozzle longitudinal axis (80).

Still referring to FIGS. 8A and 8B, preferably the outer flow director sealing ring (65) further comprises an abutment ring portion (57) circumferentially protruding inward narrowing the cross-sectional area relative to a non-abutment ring portion (not shown) of the outer flow director sealing ring (65). More preferably said abutment ring portion (57) is proximate to the first flow director cavity (not shown). When the nozzle (70) if functionally attached to the multi-composition flow director (31), preferably the thickness of the abutment ring portion (57), of the outer flow director sealing ring (65), is equal to or less than the cross-sectional thickness of an outer nozzle conduit (81) outer wall of the outer nozzle conduit (81) abutting the abutment ring portion (57). The thickness of the abutment ring portion (57) is measured in a plane orthogonally intersecting the nozzle longitudinal axis (80). The cross-sectional thickness of an outer nozzle conduit (81) outer wall is measured in a plane orthogonally intersecting the nozzle longitudinal axis (80). Preferably, the cross sectional opening of the inner flow director sealing ring (52) is less than, preferably 70% to 99%, more preferably 75% to 98%, yet more preferably 80% to 97%, of the cross sectional opening of the abutment ring portion (57) of the outer flow director sealing ring (65). The cross-sectional opening is measured in a plane orthogonal to the inner/outer flow director sealing ring longitudinal axis (60), and without nozzle (70) functionally attached to the multi-composition flow director (31). The cross sectional opening of the abutment ring portion (57) is measured in a plane orthogonal to the inner/outer flow director sealing ring longitudinal axis (60), and without nozzle (70) functionally attached to the multi-composition flow director (31)). Preferably the abutment ring portion (57) of the outer flow director sealing ring (65) is less than, preferably 70% to 99%, more preferably 75% to 98%, yet more preferably 80% to 97%, of the cross sectional opening of a non-abutment ring portion (not shown) of the outer flow director sealing ring (65). These cross sectional areas are measured in a plane orthogonal to the inner/outer flow director sealing ring longitudinal axis (60), and without nozzle (70) functionally attached to the multi-composition flow director (31)). Preferably the non-abutment ring portion is distal to the first flow director cavity (38) relative to said abutment ring portion (57) (along the inner/outer flow director sealing ring longitudinal axis (60)).

The product dispenser contains at least two or more compositions. The contained compositions can be number of different types of compositions. Non-limiting examples of these compositions including fabric care compositions, home care compositions, dish care composition, hard surface care compositions, hair care composition, oral care compositions, beauty care compositions, baby care compositions, detergent compositions, cleaning compositions, and the like. Particularly preferred are personal care composition, even more preferably skin care compositions, given the relatively small volumes that are dispensed and the advantage of the present invention to be provided in a compact execution (and yet optionally provide one or more additional advantages herein described).

Preferably the product dispenser is capable of dispensing a discrete dispensed product (from the compositions contained within the product dispenser) having defined rheologies. That is, the first and second compositions (18, 20) each having a certain defined rheology. For example, the contained compositions corresponding to the discrete dispensed product, each comprises a Crossover Stress assessed by a Portion Oscillatory Rheometry Test Method ("PORTM") as described below. Preferably at least the first or second compositions, more preferably at least the second composition, each independently comprises a Crossover Stress which is equal to or greater than 10 Pascals (Pa), preferably from 10 Pa to 120 Pa, more preferably from 10 to 80 Pa, even more preferably from 15 to 50 Pa. Non-limiting examples of the Crossover Stress of the second composition is from 15, 25, or 40 Pa. Preferably the first composition comprises a Crossover Stress, assessed by PORTM, equal to or greater than 5 Pa, preferably from 5 to 120 Pa, more preferably from 5 to 80 Pa, even more preferably from 10 to 50 Pa. Non-limiting examples of the Crossover Stress of the first composition is from 15, 25, or 40 Pa. One advantage of a second composition having such a Crossover Stress is that the second composition remains distinct by retaining its dispensed shape within the dispensed product. Preferably, in one example, the viscosity of the first composition (21) and the second composition (21) are within 25% of each other, preferably within 20%, more preferably within 15%, yet more preferably within 10%, yet still more preferably within 5% of each other.

The Portion Oscillatory Rheometry Test Method ("PORTM") is used to determine "Crossover Stress," reported in units of Pa, of a portion (e.g., the first or second portion of a discrete dispensed product) as described herein. A controlled-strain rotational rheometer (such as Discovery HR-2, TA Instruments, New Castle, Del., USA, or equivalent) capable of portion sample temperature control (using a Peltier cooler and resistance heater combination) is used for this test. Before the test, each portion sample is stored in a separated container and placed in a temperature controlled lab (23±2° C.) overnight. During the test, the lab temperature is controlled at 23±2° C. The rheometer is operated in a parallel plate configuration with 40-mm crosshatch stainless steel parallel-plate tooling. The rheometer is set at 25° C. Approximately 2 ml of the portion sample is gently loaded onto Peltier Plate using a spatula from the sample container to prevent a change in the portion sample structure, and any excess protruding sample is trimmed once the gap reaches 1000 μm after sample loading. The portion sample is then equilibrated at 25° C. for at least 120 seconds before measurement starts. In case a different rheometer is used, extend the equilibrium time appropriately to ensure the portion sample temperature achieves 25° C. before the test. The test commences with rheometer increased from strain amplitude 0.1% to 1000% in logarithmic mode with oscillation frequency fixed at 1 Hz (that is, one cycle per second) at 25° C. For each strain amplitude sampled, the resulting time-dependent stress is analyzed according to the customary logarithmic oscillatory strain formalism, known to those of skill in the art, to obtain the storage modulus (G') and loss modulus (G") at each step. A plot is made in which G' and G" (both expressed in units of Pascals, vertical axis) are plotted versus the strain amplitude (percent strain, horizontal axis). The lowest strain amplitude at which the traces for G' and G" cross (that is, when $\tan(\delta)=G''/G'=1$) is recorded. This point is defined as crossover point and the oscillation stress at this point is defined as the "Crossover Stress" and is reported to nearest whole number in units of Pa. Rheological properties measured by the rheometer provided by the present disclosure include, but are not limited to, storage modulus G', a loss modulus G", loss factor $\tan(\delta)$. Crossover point, is extracted using TRIOS software (provided by TA instrument) and is applicable for other equivalent rheology software.

It will be understood that reference within the specification to "embodiment(s)" or the like means that a particular material, feature, structure and/or characteristic described in connection with the embodiment is included in at least one embodiment, optionally a number of embodiments, but it does not mean that all embodiments incorporate the material, feature, structure, and/or characteristic described. Furthermore, materials, features, structures and/or characteristics may be combined in any suitable manner across different embodiments, and materials, features, structures and/or characteristics may be omitted or substituted from what is described. Thus, embodiments and aspects described herein may comprise or be combinable with elements or components of other embodiments and/or aspects despite not being expressly exemplified in combination, unless otherwise stated or an incompatibility is stated.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" All numeric ranges described herein are inclusive of narrower ranges; delineated upper and lower range limits are interchangeable to create further ranges not explicitly delineated. Embodiments described herein can comprise, consist essentially of, or consist of, the essential components as well as optional pieces described herein. As used in the description and the appended claims, the singular forms "a," "an," and "the" are intended to include the plural forms as well, unless the context clearly indicates otherwise.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product dispenser capable of concurrently dispensing at least a first composition and a second composition comprising:

(a) a first container for containing the first composition and a second container for containing the second composition;

(b) a multi-composition flow director comprising:

(i) a first flow director cavity in fluid communication with the first container;

(ii) a second flow director cavity in fluid communication with the second container;

(iii) an inner flow director sealing ring positioned between the first flow director cavity and second flow director cavity;

(iv) an outer flow director sealing ring opposing said inner flow director sealing ring along an inner/outer flow director sealing ring longitudinal axis, wherein the first flow cavity director cavity further comprises a circular segmental channel along the inner/outer flow director sealing ring longitudinal axis;

(c) a nozzle comprising:

(i) an inner nozzle conduit in fluid communication with the second flow director cavity and fluidly sealed against the inner flow director sealing ring;

(ii) an outer nozzle conduit, at least partially extending around the inner conduit, in fluid communication with the first flow director cavity and fluidly sealed against the outer flow director sealing ring;

(iii) wherein the length of the inner conduit is longer than the length of the outer conduit.

2. The product dispenser of claim 1, wherein the fluid seal between the inner nozzle conduit and the inner flow director sealing ring is formed between an inner nozzle conduit outer circumferential surface and an inner flow director sealing ring inner circumferential surface.

3. The product dispenser of claim 1, wherein about 3% to about 30%, of the total length of the nozzle, measured along a nozzle longitudinal axis, forms the fluid seal between the inner nozzle conduit and the inner flow director sealing ring.

4. The product dispenser of claim 3, wherein about 5% to about 25%, of the total length of the nozzle, measured along a nozzle longitudinal axis, forms the fluid seal between the inner nozzle conduit and the inner flow director sealing ring.

5. The product dispenser of claim 1, wherein the fluid seal of the outer nozzle conduit and the outer flow director sealing ring is formed between an outer nozzle conduit outer circumferential surface and an outer flow director sealing ring inner circumferential surface.

6. The product dispenser of claim 1, wherein about 10% to about 50%, of the total length of the nozzle, measured along a nozzle longitudinal axis, forms the fluid seal between the outer nozzle conduit and the outer flow director sealing ring.

7. The product dispenser of claim 6, wherein about 20% to about 40%, of the total length of the nozzle, measured along a nozzle longitudinal axis, forms the fluid seal between the outer nozzle conduit and the outer flow director sealing ring.

8. The product dispenser of claim 1, wherein the length of the outer nozzle conduit is about 30% to about 99%, of the length of the inner nozzle conduit.

9. The product dispenser of claim 8, wherein the length of the outer nozzle conduit is about 40% to about 90%, of the length of the inner nozzle conduit.

10. The product dispenser of claim 1, wherein the outer flow director sealing ring further comprises an abutment ring portion circumferentially protruding inward narrowing the cross-sectional area relative to a non-abutment ring portion of the outer flow director sealing ring.

11. The product dispenser of claim 10, wherein said abutment ring portion is proximate to the first flow director cavity.

12. The product dispenser of claim 10, wherein the thickness of the abutment ring portion is equal to or less than the cross-sectional thickness of an outer nozzle conduit outer wall of the outer nozzle conduit abutting the abutment ring portion.

13. The product dispenser of claim 10, wherein the cross sectional opening of the inner flow director sealing ring is about 70% to about 99% of the cross sectional opening of the abutment ring portion of the outer flow director sealing ring.

14. The product dispenser of claim 10, wherein the abutment ring portion of the outer flow director sealing ring is about 70% to about 99% of the cross sectional opening of a non-abutment ring portion of the outer flow director sealing ring.

15. The product dispenser of claim 14, wherein the abutment ring portion of the outer flow director sealing ring is about 75% to about 98% of the cross sectional opening of a non-abutment ring portion of the outer flow director sealing ring.

16. The product dispenser of claim 15, wherein said non-abutment ring portion is distal to the first flow director cavity relative to said abutment ring portion.

17. The product dispenser of claim 10, wherein the cross-sectional shape of the abutment ring portion of the outer flow director sealing ring, the non-abutment ring portion of the outer flow director sealing ring, and the inner flow director sealing ring are each independently selected from a circular or oval.

18. The product dispenser of claim 1, wherein a cross section of the circular segmental channel in a plane orthogonal to and relative to the inner/outer flow director sealing ring longitudinal axis, is about 1 to about 4 radians.

19. The product dispenser of claim 1, wherein:

(a) the first flow director cavity further comprises a first cavity inlet planar opening, wherein the first cavity inlet planar opening comprises a first cavity inlet planar opening centroid, wherein a first cavity inlet axis orthogonally intersects said first cavity inlet planar opening centroid;

(b) the second flow director cavity comprises a second cavity inlet planar opening, wherein the second cavity inlet planar opening comprises a second cavity inlet planar opening centroid, wherein a second cavity inlet axis orthogonally intersects said second cavity inlet planar opening centroid;

(c) a nozzle longitudinal axis along the nozzle; and (d) wherein an inlet intersecting plane intersects the first cavity inlet axis and the second cavity inlet axis, and the nozzle longitudinal axis intersects said plane to from an angle about 60 degrees to about 90 degrees.

* * * * *